US011629559B2

(12) United States Patent
Ziegler et al.

(10) Patent No.: US 11,629,559 B2
(45) Date of Patent: Apr. 18, 2023

(54) APPARATUS FOR CONNECTING DRILLING COMPONENTS BETWEEN RIG AND RISER

(71) Applicant: Weatherford Technology Holdings, LLC, Houston, TX (US)

(72) Inventors: Robert Ziegler, Houston, TX (US); Julmar Shaun S. Toralde, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 395 days.

(21) Appl. No.: 16/797,175

(22) Filed: Feb. 21, 2020

(65) Prior Publication Data

US 2020/0270953 A1 Aug. 27, 2020

Related U.S. Application Data

(60) Provisional application No. 62/944,044, filed on Dec. 5, 2019, provisional application No. 62/808,640, filed on Feb. 21, 2019.

(51) Int. Cl.
*E21B 17/02* (2006.01)
*E21B 17/08* (2006.01)
(Continued)

(52) U.S. Cl.
CPC ..... *E21B 17/021* (2013.01); *E21B 17/046* (2013.01); *E21B 17/085* (2013.01); *E21B 34/066* (2013.01); *E21B 17/01* (2013.01)

(58) Field of Classification Search
CPC .... E21B 17/021; E21B 17/046; E21B 17/085; E21B 34/066; E21B 17/01; E21B 33/0387; E21B 33/038
See application file for complete search history.

(56) References Cited

U.S. PATENT DOCUMENTS 4,668,126 A 5/1987 Burton
6,938,695 B2 9/2005 Williams
(Continued)

FOREIGN PATENT DOCUMENTS

EP 2499327 A2 9/2012
WO 2014120130 A1 7/2014
WO 2019033126 A1 2/2019

OTHER PUBLICATIONS

Int'l Search Report received in copending PCT Application No. PCT/US2020/019169 dated Jun. 22, 2020, 13 pages.
Offshore, Integrated MPD system aids in drilling operation offshore Brazil, obtained from www.offshore-mag.com/, dated Oct. 14, 2016, 10 pages.
(Continued)

*Primary Examiner* — Abby J Flynn
*Assistant Examiner* — Yanick A Akaragwe
(74) *Attorney, Agent, or Firm* — Cabello Hall Zinda, PLLC

(57) ABSTRACT

A riser extending from a floating rig has a riser manifold. A rig manifold can be manipulated by an arm to couple in an automated manner to the riser manifold when running the riser from the rig. The riser and rig manifolds have mechanical connectors that mechanically connect them. Additionally, the manifolds have flow couplings mating together for conducting flow in at least one flow connection, and the manifolds control couplings mating together for conducting control in at least one flow connection. At least one of the manifolds has at least one valve controllable with the at least one control connection and configured to control fluid communication for the at least one flow connection between at least one rig flow line and an internal passage of the riser.

26 Claims, 12 Drawing Sheets

(51) Int. Cl.

| | |
|---|---|
| ***E21B 34/06*** | (2006.01) |
| ***E21B 17/046*** | (2006.01) |
| ***E21B 17/01*** | (2006.01) |

(56) References Cited

U.S. PATENT DOCUMENTS

| | | | | |
|---|---|---|---|---|
| 7,040,393 | B2 | 5/2006 | Adams et al. | |
| 7,658,228 | B2 | 2/2010 | Moksvold | |
| 8,267,179 | B2 | 9/2012 | Butcher et al. | |
| 8,875,793 | B2 | 11/2014 | Christensen et al. | |
| 9,458,689 | B2 | 10/2016 | Mancuso et al. | |
| 9,702,205 | B2 | 7/2017 | Jansen et al. | |
| 9,719,310 | B2 | 8/2017 | MacGregor et al. | |
| 2008/0210471 | A1 | 9/2008 | Bailey et al. | |
| 2011/0056701 | A1 | 3/2011 | Jones et al. | |
| 2011/0253445 | A1* | 10/2011 | Hannegan | E21B 47/001 175/5 |
| 2011/0266003 | A1 | 11/2011 | Singh et al. | |
| 2012/0318517 | A1* | 12/2012 | Christensen | E21B 19/004 166/345 |
| 2013/0014991 | A1 | 1/2013 | Leuchtenberg | |
| 2013/0168101 | A1 | 7/2013 | Bryson et al. | |
| 2013/0168578 | A1 | 7/2013 | Leuchtenberg et al. | |
| 2013/0233562 | A1 | 9/2013 | Leuchtenberg | |
| 2013/0240214 | A1 | 9/2013 | Faye | |
| 2014/0048331 | A1 | 2/2014 | Boutalbi et al. | |
| 2014/0048731 | A1 | 2/2014 | Leuchtenberg et al. | |
| 2016/0076323 | A1 | 3/2016 | Fraczek et al. | |
| 2016/0230480 | A1* | 8/2016 | Jansen | E21B 19/004 |
| 2019/0195032 | A1* | 6/2019 | Clark | E21B 33/085 |

OTHER PUBLICATIONS

AFGlobal, "MPD Active Pressure Management", copyright 2017, 10 pages.

Offshore, "Asia/Pacific-spurs-demand-for-integrated deepwater MPD systems," obtained from www.offshore-mag.com, Mar. 11, 2015, 11 pages.

Mi Swaco, "Below Tension Ring Rotating Control Device—18 3/4-in submersible rotating control device", Brochure, copyright 2019, 2 pages.

FES International, "Hydraulic/Electric/Fibre Optic Stab Plates", undated, obtained from www.fesintemational.com on Jan. 20, 2019, 7 pages.

Future Production A/S, "Handsfree Gooseneck Handling System", Product & Operations Bulletin, Rev. Apr. 24, 2017, 3 pages.

Hess, "Deepwater MPD Jakarata Drilling Superintendents Meeting", Oct. 12, 2011, 16 pages.

Weatherford, "Seashield Rotating Control Devices Enabling closed-loop drilling in all marine environments using the industry's most reliable RCDs," copyright 2016, 16 pages.

Unitech, "MQC Terminator Charlie X-I Rov-Operated MQC/Stab Plate", undated, obtained from unitechsubsea.com on, Jan. 20, 2019, 2 pages.

Drilling Contractor, "RCD-for-dp-drillship-takes-mpd-deeper," obtained from www.drillingcontractor.org, dated Jul. 14, 2011, 4 pages.

Schlumberger, "First Deepwater MPD Integrated Solution Enables Drilling 5,302-ft Interval in One Run", Brochure, copyright 2018, 2 pages.

Subsea Connection Systems, "Stap Plates and Quick Couplings MCD Series Plates/DSL Series Couplings QCD-MCD/DSL", Apr. 2016, 4 pages.

* cited by examiner

APPARATUS FOR CONNECTING DRILLING COMPONENTS BETWEEN RIG AND RISER

CROSS-REFERENCE TO RELATED APPLICATIONS

This application claims the benefit of U.S. Appl. No. 62/944,044 filed 5 Dec. 2019 and U.S. Appl. No. 62/808,640 filed 21 Feb. 2019, which are both incorporated herein by reference in their entireties. This application is also filed concurrently with U.S. application Ser. No. 16/797,148, which is incorporated herein by reference.

BACKGROUND OF THE DISCLOSURE

Drilling operations offshore use a riser that connects from a drilling vessel or rig to a BOP stack, which is mounted on a wellhead on the sea floor. To deploy the BOP stack and the riser to the wellhead, the BOP stack is skidded in at a sledge in a moonpool at a cellar deck under the rig floor. A section of riser is installed via a ball joint to the BOP stack. Kill and choke lines from the BOP stack are run past the ball joint and are coiled a few turns on the riser section to accommodate the torsional movements in the ball joint.

The BOP stack and riser section are then lowered from the rig floor, and the riser section is held in a spider. Thereafter, additional sections of riser are connected one to another as the riser and the BOP stack are lowered from the rig until the BOP stack reaches the depth of the wellhead. This process terminates by installing a slip joint on top of the last riser section. A typical slip joint has a lower outer barrel and an upper inner barrel, which can slide in the outer barrel. In this way, the sliding inner barrel hung from the vessel can follow the vertical movements of the vessel.

These deployment steps typically take place outside the template of the wellhead on the seafloor to prevent a catastrophe should the riser be lost and dropped. Once the riser is lowered to depth, the BOP stack and the riser are brought over the template, and the BOP stack is then lowered down to lock onto the wellhead at the seafloor.

During drilling operations, the riser guides a drillstring from the rig floor to the BOP stack, through which the drillstring can pass to drill further downhole in a formation. During drilling, drilling fluid is pumped from a mud pump system at the rig, down through the drillstring, and out through the drill bit. The drilling fluid washes the bit and the bottom of the hole clean of cuttings. The density and the viscous properties of the drilling fluid then brings the cuttings back up through the borehole, up through the BOP stack, and finally up through the riser to the rig.

Normally, kill and choke lines are run from the rig and along the riser to control operations. For example, the kill line can deliver heavy fluid used to "kill" the well, and the choke line can deliver flow from the BOP stack to an appropriate kill-choke manifold for well control. The drillstring can be cut by a shear ram in the BOP stack, or a choke ram can be closed around the drillstring in the BOP stack. In addition to the kill and choke lines, there may be conduit-lines for controlling hydraulic valves and connections in the BOP stack, and there may be "booster" lines for injecting fluid. The riser may also have flow control devices that are connected to lines on the rig.

Flow hoses and umbilicals from the rig must be connected to the riser lines so flow, hydraulics, and the like can be communicated to the flow control elements and the BOP stack. The flow hoses and umbilicals are connected while the riser is being run and the BOP stack is a few feet above the depth of the wellhead. Typically, the connection is done manually with assistance from operators who hang in ride belts. A considerable amount of rig time is needed for the operators to rig up the flow hoses and umbilicals while the riser is sitting in the spider. This typically requires a window of two or more days of suitable weather to avoid high loads on the riser should the weather turn bad.

The subject matter of the present disclosure is directed to overcoming, or at least reducing the effects of, one or more of the problems set forth above.

SUMMARY OF THE DISCLOSURE

According to the present disclosure, an apparatus is used for connecting at least one rig line of a managed pressure drilling (MPD) system and of a kill-choke system on a floating rig to a riser. The rig lines include a first MPD flow line in communication with the MPD system and include a first kill-choke flow line in communication with the kill-choke system. The riser has an internal passage.

The apparatus comprises a riser manifold and a rig manifold. The riser manifold is disposed on the riser and comprises: a first mechanical connector, a first flow coupling for conducting a first MPD flow of the MPD system, and a second flow coupling for conducting a first kill-choke flow of the kill-choke system.

The rig manifold is configured to removably position adjacent the riser manifold. The rig manifold comprises: a second mechanical connector disposed thereon, a third flow coupling disposed in communication with the first MPD flow line for conducting first MPD flow, and a fourth flow coupling disposed in control communication with the first kill-choke flow line for conducting the first kill-choke flow.

The first and second mechanical connectors are configured to mechanically connect together. The third flow coupling is configured to mate in a first MPD flow connection with the first flow coupling for conducting the first MPD flow. The fourth flow coupling is configured to mate in a first kill-choke connection with the second flow coupling for conducting the first kill-choke flow.

In general, the rig lines can include at least one second MPD flow line in communication with the MPD system. The riser manifold can comprise at least one fifth flow coupling for conducting at least one second MPD flow of the MPD system, and the rig manifold can comprise at least one sixth flow coupling disposed in flow communication with the at least one second MPD flow line for conducting at least one second MPD flow. The at least one sixth flow coupling can be configured to mate in at least one second MPD flow connection with the at least one fifth flow coupling for conducting the at least one MPD flow.

In general, the rig lines can include at least one second kill-choke flow line in communication with the kill-choke system. The riser manifold can comprise at least one seventh flow coupling for conducting at least one second kill-choke flow of the kill-choke system. The rig manifold can comprise at least one eighth flow coupling disposed in flow communication with the at least one second kill-choke flow line for conducting the at least one second kill-choke flow. The at least one eighth flow coupling cam be configured to mate in at least one second kill-choke flow connection with the at least one seventh flow coupling for conducting the at least one second kill-choke flow.

In general, the at least one second MPD flow conducted by the at least one second MPD connection can be different from the first MPD flow conducted by the first MPD connection.

The first mechanical connector can comprise a pair of guide sleeves defined in a first face of the riser manifold, and the second mechanical connector can comprise a pair of guide posts extending from a second face of the rig manifold. The guide posts can be configured to insert into the guide sleeves to mechanically connect the rig manifold to the riser manifold.

The first flow coupling can comprise a female receptacle defined in a first face of the riser manifold, and the second flow coupling can comprise a male nipple extending from a second face of the rig manifold. The male nipple can be configured to insert into the female receptacle to make the first MPD flow connection.

The apparatus can further comprise an arm extending from the floating rig and supporting the rig manifold. The arm can be configured to: move the rig manifold relative to the riser manifold, mate the rig manifold to the riser manifold, and disconnect from the rig manifold. The arm can be further configured to: connect to the rig manifold mated with the riser manifold, and remove the rig manifold from the riser manifold. The rig manifold can define a plurality of carry slots therein, and the arm can comprise a plurality of carry posts removably inserted in the slots of the rig manifold. Moreover, the second mechanical connector can comprise a rotatable lock, and the arm can comprise a rotatable key removably engaging the rotatable lock.

The rig lines can include a control line for conducting control. A first face of the riser manifold can further comprise a first control coupling for conducting the control, and a second face of the rig manifold can further comprises a second control coupling for conducting the control. The second control coupling can be configured to mate in a control connection with the first control coupling for conducting the control.

The first control coupling can comprise a female electrical coupling, a female hydraulic coupling, and a female fiber optic coupling, and the second control coupling can comprise a male electrical coupling, a male hydraulic coupling, and a male fiber optic coupling. Each of the first and second control couplings can be adjustable relative to the first and second face.

For the apparatus having the control connection, the riser manifold can further comprise a valve integrated therein. The valve can be controllable with the control connection and can be configured to control the flow communication for the first MPD flow connection.

For the apparatus having the control connection, the apparatus can comprise a first mating plate disposed on the first face and having the first control coupling; and a second mating plate disposed on the second face and having the second control coupling. At least one of the first and second mating plates can be adjustable relative to the respective first and second face. For this arrangement, the second face can define a cavity therein, and the second mating plate can be disposed in the cavity and can adjustable relative to the second face. Moreover, the second mating plate can be adjustable longitudinally, laterally, or both relative to the second face. Further, each of the first control couplings can be adjustable relative to the at least one first mating plate.

For the apparatus having the control connection, the apparatus can further comprise a flow control device disposed on the riser and being configured to at least partially control communication of the internal passage of the riser. The flow control device can be disposed in at least one of: (i) flow communication with the first flow coupling, (ii) flow communication with the second flow coupling, and (iii) control communication with the first control coupling.

The flow control device can comprise a valve disposed in the flow communication with the first flow coupling and disposed in the control communication with the first control coupling. The valve can be controllable to control the flow between the first flow coupling and the internal passage of the riser.

The flow control device can comprise a seal configured to at least partially control flow in the internal passage of the riser. Moreover, the seal can comprise an actuator disposed in the control communication with the first control coupling.

The riser can have riser lines including a riser flow line for conducting the flow and including a riser control line for conducting the control. The first or second flow coupling can be disposed in the flow communication with the flow control device via the riser flow line, and the first control coupling can be disposed in the control communication with the flow control device via the riser control line.

In general, the flow control device can comprise at least one of: a rotating control device disposed in the control communication with the first control coupling; an annular seal device disposed in the control communication with the first control coupling; and a controllable flow spool valve disclosed in the control communication with first control coupling and disposed in the flow communication between the internal passage of the riser and the first flow coupling.

In an alternative, the flow control device can comprise a wellhead component of a blow-out preventer connected to the riser and disposed in the flow communication between the internal passage of the riser and the second flow coupling.

For the apparatus, the riser and rig manifolds can comprise another flow connection between couplings comprising at least one of a boost connection, a glycol injection connection, a hot connection, a spare connection, and a pumped riser connection.

At least one of the rig and riser manifold can comprise a valve integrated therein, the valve controllable with a control connection and configured to control the flow communication for the first MPD flow connection. For example, the rig lines can include an MPD control line in communication with the MPD system, and the rig manifold can comprise the valve integrated therein and disposed in control communication with the MPD control line.

According to the present disclosure, an apparatus is used for connecting rig lines of a floating rig to a riser. The rig lines include a rig flow line for conducting flow and include a rig control line for conducting control. The riser has an internal passage. The apparatus comprises a riser manifold and a rig manifold.

The riser manifold is disposed on the riser and comprises: a first mechanical connector disposed thereon, a first flow coupling for conducting the flow, and a first control coupling for conducting the control. The rig manifold is configured to removably position adjacent the riser manifold. The rig manifold comprises: a second mechanical connector disposed thereon, a second flow coupling for conducting the flow, and a second control coupling for conducting the control.

The first and second mechanical connectors are configured to mechanically connect together. The second flow coupling is configured to mate in a flow connection with the first flow coupling for conducting the flow, and the second control coupling is configured to mate in a control connection with the first control coupling for conducting control. At least one of the riser and rig manifolds comprising a valve controllable with the control connection and configured to control flow communication for the flow connection.

The apparatus can further comprise a flow control device disposed on the riser and configured to at least partially control communication of the internal passage of the riser. The flow control device can be disposed in communication with at least one of the first flow coupling and the first control coupling.

According to the present disclosure, an apparatus is used for connecting rig lines of a managed pressure drilling (MPD) system and a kill-choke system on a floating rig to a riser. The riser has an internal passage and has a kill-choke line for a kill-choke component. The apparatus a managed pressure drilling (MPD) device, a riser manifold, and a rig manifold.

The MPD device is disposed on the riser and is configured to at least partially control fluid communication through the internal passage of the riser. The riser manifold is also disposed on the riser and comprises: a first mechanical connector disposed thereon, a first coupling disposed in communication with the MPD device, and a second coupling disposed in communication with the kill-choke line. Meanwhile, the rig manifold is configured to removably position adjacent the riser manifold. The rig manifold comprises: a second mechanical connector disposed thereon, a third coupling disposed in communication with the MPD system, and a fourth coupling disposed in communication with the kill-choke system.

The first and second mechanical connectors are configured to mechanically connect together. The third coupling is configured to mate with the first coupling and configured to communicate therewith. For example, the third and first couplings can mate in a flow connection or a control connection for the MPD system. The fourth coupling is configured to mate with the second coupling and is configured to communicate therewith. For example, the fourth and second couplings can mate in a flow connection or a control connection for the kill-choke system.

As can be seen, the apparatus can comprises at least one riser manifold and at least one rig manifold that mate together. Each of the riser and rig manifolds can have at least one mechanical connector, at least one flow coupling, and at least one control coupling to mate together to connect an MPD system and kill-choke system on a floating rig to the riser. At least one controllable valve can be integrated into either one or both of the rig and riser manifolds. Additionally, the apparatus can include at least one flow device disposed on the riser and in flow communication and/or control communication with the riser manifold and its couplings.

According to the present disclosure, a method is used to run a riser from a floating rig to a subsea wellhead. The floating rig has rig lines including at least one rig flow line for conducting flow and including at least one rig control line for conducting control. The riser has an internal passage.

The method comprises: positioning a riser manifold on the riser, connecting a first flow coupling on the riser manifold in flow communication via a flow connection to the internal passage of the riser, and connecting a first control coupling on the riser manifold in control communication via a control connection; connecting a second flow coupling on a rig manifold to the rig flow line, and connecting a second control coupling on the rig manifold to the rig control line; connecting a controllable valve of at least one of the rig and riser manifold to the control connection, and configuring the controllable valve to control the flow communication for the flow connection between the rig flow line and the internal passage of the riser; and mating the second flow coupling in flow communication with the first flow coupling and mating the second control coupling in control communication with the first control coupling by manipulating the rig manifold on an arm toward the riser manifold and remotely affixing a second mechanical connector of the rig manifold to the first mechanical connector of the riser manifold.

The foregoing summary is not intended to summarize each potential embodiment or every aspect of the present disclosure.

DETAILED DESCRIPTION OF THE DISCLOSURE

Figure 1A:
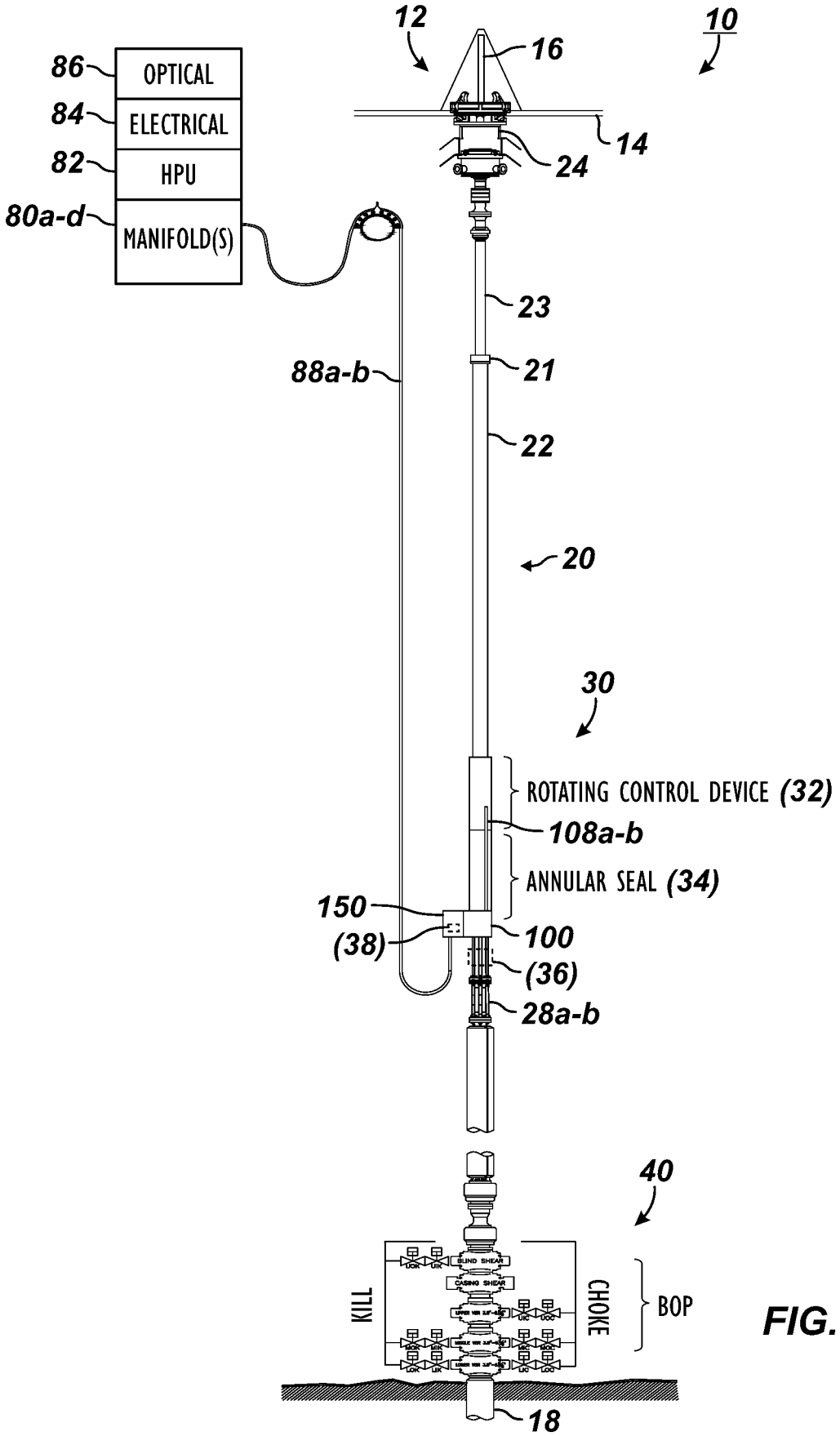
FIG. 1A illustrates a drilling system according to the present disclosure.
Figure 1B:
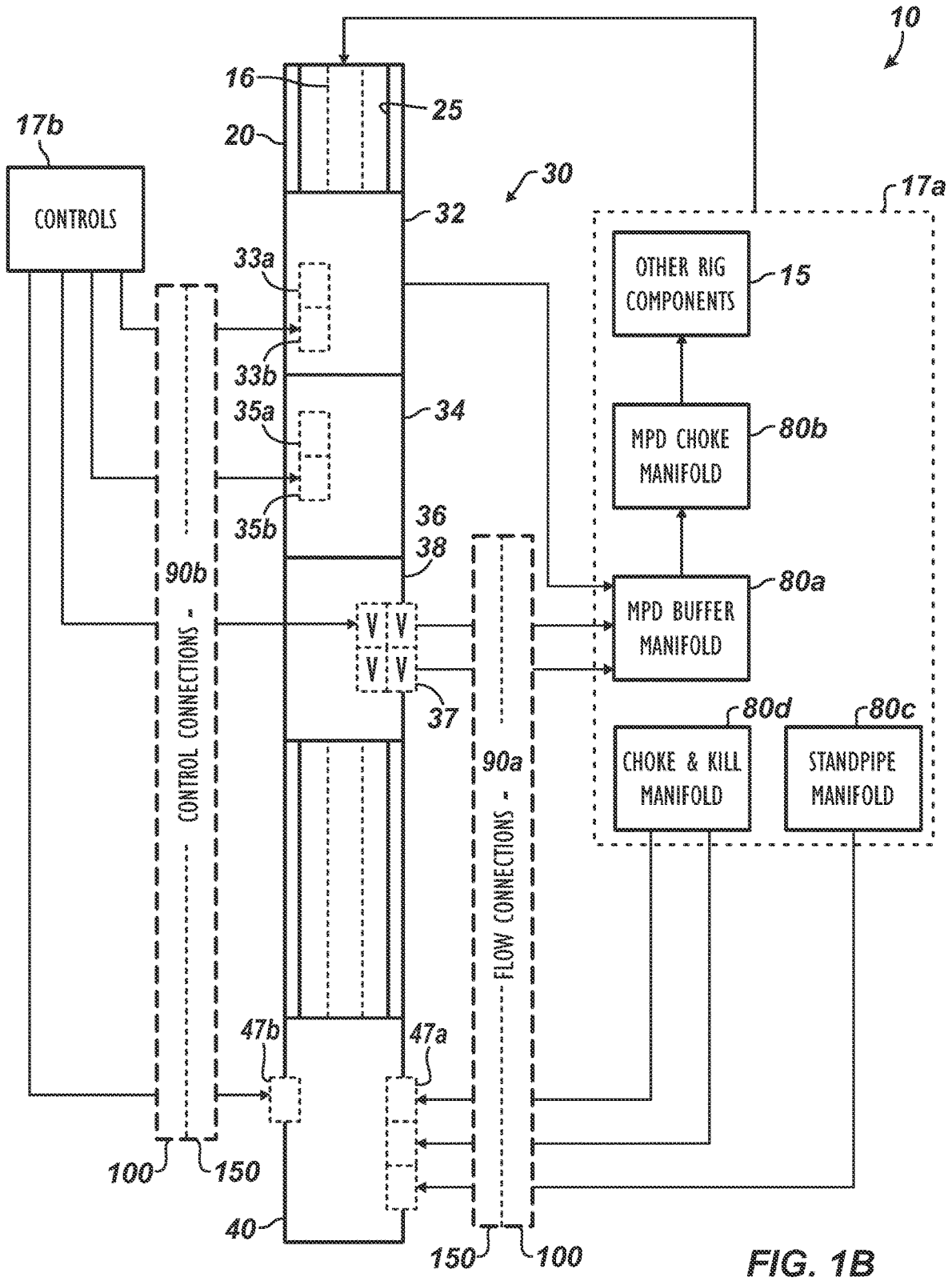
FIG. 1B illustrates a schematic view of flow and control connections between rig and riser components of the drilling system.

FIGS. 1A-1B diagram a drilling system 10 according to the present disclosure. As shown and discussed herein, this drilling system 10 can be a closed-loop system for controlled pressure drilling, namely a Managed Pressure Drilling (MPD) system and, more particularly, a Constant Bottom-hole Pressure (CBHP) form of MPD system. Although discussed in this context, the teachings of the present disclosure can apply equally to other types of drilling systems, such as conventional drilling systems, other MPD systems (Pressurized Mud-Cap Drilling, Returns-Flow-Control Drilling, Dual Gradient Drilling, etc.) as well as to Underbalanced Drilling (UBD) systems, as will be appreciated by one skilled in the art having the benefit of the present disclosure.

The drilling system 10 is depicted in FIG. 1A for use offshore on a rig 12, such as a floating, fixed, or semi-submersible platform or vessel known in the art, although teachings of the present disclosure may apply to other arrangements. The drilling system 10 uses a riser 20 extending between a diverter 24 on the rig floor 14 to a blow-out preventer (BOP) stack 40 on the sea floor.

As is known, the riser 20 is a tubular element having an internal passage (25: FIG. 1B) that allows a drillstring 16 from the rig 12 to pass to the wellhead BOP stack 40 on the sea floor. The annulus in the riser's internal passage (25) around the drillstring 16 can communicate fluid returns from the wellhead BOP stack 40 up to the rig 12 or other components during drilling.

The riser 20 connects by a riser joint from the diverter 24 and includes a managed pressure drilling (MPD) riser unit 30 disposed on the riser 20. The MPD riser unit 30 has one or more flow control devices and has a riser manifold 100. As shown here, the flow control devices include a rotating control device (RCD) 32 and an annular isolation/sealing device 34 disposed along the length of the riser 20. A flow spool (36) of the unit 30 having a number of controllable valves may also be disposed on the riser 20 adjacent the riser manifold 100. Alternatively and as discussed in more detail later, the riser manifold 100 may include these controllable valves integrated therein, and/or a rig manifold 150 can include flow components (38) having these controllable valves integrated therein. Other flow control devices for an MPD-type system can be used.

A slip joint 21 on top of the riser 20 has an outer barrel 22 through which an inner barrel 23 can pass to account for heave of the rig 12. The flow control devices (i.e., rotating control device 32, the annular isolation device 34, and optional flow spool (36)) of the riser unit 30 are disposed on the riser 20 below the slip joint 21, and the riser manifold 100 can be disposed on the riser 20 adjacent the flow control devices 32, 34, (36). As shown here, the riser manifold 100 can be disposed below the rotating control device 32 and annular isolation device 34 and can be disposed at or above the flow spool (36) on the riser 20, but other configurations are possible.

In any event, the riser manifold 100 disposed below the rotating control device 32 and the annular isolation device 34 means that any riser lines or flow connections for the rotating control device 32, the annular isolation device 34, and the wellhead BOP stack 40 do not need to run along the riser 20 from the slip joint 21 and around the rotating control device 32, the annular isolation device 34, and the like as is conventionally done. Instead, riser lines 28*a-b* extend from the riser manifold 100 to further components, such as the wellhead BOP stack 40, do not have to pass around the rotating control device 32, the annular isolation device 34, and the like. Additionally, any flow or control connections from the riser manifold 100 to the rotating control device 32 and the annular isolation device 34 can pass a short distance from the riser manifold 100 via external or internal riser connections 108*a-b*.

During drilling operations, the drillstring 16 having a bottom hole assembly (BHA) and a drill bit may extend as shown in FIG. 1A downhole through the internal passage (25) of the riser 20 and into a wellbore 18 for drilling into a formation. The riser 20 can then direct returns of drilling fluids, wellbore fluids, and earth-cuttings from the subsea wellbore 18 to the rig 12. In some conventional forms of operation, the diverter 24 can direct the returns of drilling fluid, wellbore fluid, and earth-cuttings to a mud gas separator (not shown) and other elements on the rig 12 to separate out the drilling fluid for potential recycle and reuse, and to separate out gas.

In other forms of operations, such as managed pressure drilling, the one or more flow control devices 32, 34, (36) are used to direct the returns of drilling fluid, wellbore fluid, and earth-cuttings to elements (i.e., manifolds 80*a-b*) of the rig 12. In other situations, heavy fluids are delivered from rig components (i.e., manifold 80*c*) through kill lines 58*a*, 29*a* on the rig 12 to the BOP stack 40 to "kill" the well; the choke lines 29*b*, 88*a-d* can deliver flow from the BOP stack 36 to appropriate rig components (i.e., kill-choke manifold 80*c*) for well control; the drillstring 16 can be cut by a shear ram in the BOP stack 40; or a choke ram can be closed around the drillstring 16 in the BOP stack 40.

As discussed below, rig lines 88*a-b* connect from rig components on the rig. These rig lines 88*a-b* include flow lines 88*a* for conducting flow and include control lines 88*b* for conducting control. For example, flow lines 88*a* can include flow hoses for communicating managed pressure drilling flow, kill and choke flow, and the like for the flow connections (90*a*; FIG. 1B) between the mating manifolds 100, 150. Likewise, the control lines 88*b* can include hydraulic lines, electric cables, umbilicals, etc. for communicating managed pressure drilling control, kill and choke control, and the like for the control connections (90*b*; FIG. 1B) between the mating manifolds 100, 150. These have been described as being configured for combined connection with the mating manifolds 100, 150 for both MPD-type and kill-and-choke-type connections, which helps with organization. As will be appreciated with the benefit of the present disclosure, however, other arrangements are possible.

To connect to the flow control devices 32, 34, (36, 38), the BOP stack 40, other components, sensors, and the like on the riser 20, the rig lines 80*a-b* extend from manifolds 80*a-d*, hydraulic elements 82, electrical elements 84, optical elements 86, and the like on the rig 12 and connect by the rig manifold 150 to the riser manifold 100 disposed on the riser 20. In general, the rig lines 88*a-b* can include flow hoses, hydraulic lines, electric cables, umbilicals, etc. For example, flow lines 88*a* of one or more rig manifolds 80*a-b* can connect to flow diverted by the rotating control device 32 or annular isolation device 34 from the riser's internal passage (25) to the flow spool components (36, 38). Additionally, flow lines 88*a* of one or more rig manifolds 80*c-d* can connect through the rig and riser manifolds 150, 100 to components of the BOP stack 40. Also, electrical and hydraulic elements or controls 82 and 84 can connect by control lines 88*b* to the rotating control device 32, the annular isolation device 34, the flow spool components (36, 38), the BOP stack 40, and the like to control their operation. For example, control lines 88*b* can carry supply and/or return of hydraulic fluid to and from the devices 32, 34, (36, 38) and the BOP stack 40 for their operation.

In general, the flow control devices 32, 34, (36, 38) can have flow connection(s) to the riser manifold 100 for communicating flow between the riser 20 and rig flow line(s) 88*a*. For example, the rotating control device 32 allows flow of drilling fluids up the annulus of the riser 20 to be diverted to the riser flow line(s) 88*a* through the flow spool components (36, 38) and mated manifolds 100, 150. In another example, the flow control devices on the riser 20 can include the flow spool 36 as noted previously that has a plurality of controllable valves for controlling flow between the internal passage (25) of the riser 20 and the rig flow lines 88*a*, such as the flow in the riser 20 diverted by the rotating control device 32 or annular isolation device 34. The valves of the flow spool (36) can have flow and control connections to the rig lines 88*a-b*. Preferably and as discussed in more detail below, the rig manifold 150 instead includes flow components (38) having a plurality of valves for controlling flow of fluid in/out of the internal passage (25) of the riser 20. In this way, a separate flow spool (36) does not need to be installed on the riser 20 as is conventionally done.

In general, the flow control device 32, 34, (36, 38) can have control connection(s) to the riser manifold 100 for communicating controls from riser control line(s) 88*b*. For example, the rotating control device 32, the annular isolation device 34, and the flow components (36, 38) can have hydraulic connections to receive hydraulic controls from the riser control line(s) 88*b*, and these devices 32, 34, and (36, 38) can have electrical connections or other control connections to communicate with actuators, sensors, and the like.

For instance, the rotating control device 32, which can include any suitable pressure containment device, keeps the wellbore 18 in a closed-loop at all times while the wellbore 18 is being drilled. To do this, the rotating control device (RCD) 32 sealingly engages (i.e., seals with an annular rotating seal 33*a* of FIG. 1B against) the drillstring 16 passing in the internal passage (25) of the riser 20 so contained and diverted annular drilling returns can flow through the mated manifolds 100, 150, which in turn connect to downstream flow components 80*a-b* on the rig 12. In this way, the rotating control device 32 can complete a circulating system to create the closed-loop of incompressible drilling fluid.

The annular isolation device 34 can be used to sealingly engage (i.e., seal with an annular isolation seal 35*a* of FIG. 1B against) the drillstring 16 or to fully close off the riser 20 when the drillstring 16 is removed so fluid flow up through the riser 20 can be prevented. Typically, the annular isolation device 34 can use a sealing element that is closed radially inward by an actuator (e.g., hydraulically actuated pistons 35*b* of FIG. 1B or other form of actuator). Control lines 88*b* from hydraulic components 82 on the rig 12 can be used to deliver controls to the annular isolation device 34.

The flow spool (36) or the flow components (38) within the rig manifold 150 can include a number of controllable valves that connect the internal passage (25) of the riser 20 with rig components 80*a-b* on the rig 12. Flow lines 88*a* from the riser 20 may be used to communicate flow between the controllable valves, and control lines 88*b* on the riser 20 may also be used to deliver controls to open and close the controllable valves.

In addition to the connections discussed above, the rig flow lines 88*a* can connect manifolds 80*c-d* on the rig 12 to the BOP stack 40 through the mated riser and rig manifolds 100, 150. Additionally, the control lines 88*b* can connect hydraulic controls 82, electrical controls 84, optical controls 86, and the like on the rig 12 to the BOP stack 40 through the mated riser and rig manifolds 100, 150. For example, electrical and hydraulic controls 84, 86 can connect by control rig lines 88*b* and riser lines 28*b* to the BOP stack 40 to control its operation. For example, the control lines 88*b*/28*b* can carry supply and/or return of hydraulic fluid to and from the BOP stack 40 for its operation.

For additional reference, FIG. 1B illustrates a schematic view of flow connections 90*a* and control connections 90*b* achieved with the mating manifolds (110, 150) between the rig and riser components of the drilling system 10. As shown generally, one or more rig flow components 17*a* (e.g., MPD system and kill-choke system of the rig 12) connect to one or more riser flow components 21*a* (e.g., the rotating control device 32, the annular isolation device 34, the flow spool 36, the BOP stack 40, etc.) through one or more flow connections 90*a* of the mating manifolds (100, 150). Likewise, one or more rig control components 17*b* (e.g., elements 82, 84 & 86 of the rig 12) connect to one or more riser control components 21*b* (e.g., of the rotating control device 32, the annular isolation device 34, the flow spool 36, the BOP stack 40, etc.) through one or more control connections 90*b* of mating manifolds (100, 150).

The rig controls 17*b* can include connections to sensors 33*b* or the like on the rotating control device 34. The rig controls 17*b* can include an RCD hydraulic pressure unit (82) for providing the hydraulic controls 33*b* for the rotating control device 32. Another hydraulic pressure unit (82) can include a managed pressure drilling unit for controlling the hydraulic controls 33*b* that control flow for the rotating control device 32 and for controlling the controllable valves 37 of the flow spool or flow components (36, 38).

As shown in FIG. 1B, manifolds 80*a-b* downstream of the rotating control device 32, the annular isolation device 34, and the flow components (36, 38) can include a buffer manifold 80*a* and a choke manifold 80*b*. The buffer manifold 80*a* connects by the flow connections 90*a* of the manifolds (100, 150) from the rotating control device 32, the annular isolation device 34, and the flow components (36, 38) and receives flow returns during drilling operations. Among other components, the buffer manifold 80*a* may have pressure relief valves (not shown), pressure sensors (not shown), electronic valves (not shown), and other components to control operation of the buffer manifold 80*a*.

The choke manifold 80*b* is typically downstream from the buffer manifold 80*a*. The choke manifold 80*b* can produce surface backpressure to perform managed pressure drilling with the drilling system 10 and can measure parameters of the flow returns. Among other components, for example, the choke manifold 80*b* may have flow chokes (not shown), a flowmeter (not shown), pressure sensors (not shown), a local controller (not shown), and the like to control operation of the choke manifold 80*b*.

During operations, for example, the drillstring 16 passing from the rig 12 can extend through the riser 20 and through the BOP stack 40 for drilling the wellbore 18. As the drillstring 16 is rotated, the rotating control device 32 seals the annulus between the drillstring 16 and the riser 20 to conduct a managed pressure drilling operation. To do this, the rotating control device 32 includes one or more seals 33*a* to seal the annulus around the drillstring 16 passing through the riser's internal passage 25. The rotating control device 32 can also include actuators, sensors, valves, or other control components 33*b* that connect through control connections 90*b* of the manifolds (110, 150) to rig controls 17*b*, such as a hydraulic pressure unit (82), electrical sensor components (84), etc. In this way, flow returns having drilling fluid, wellbore fluid, and cuttings flow up through the annulus between the drillstring 16 and the riser 20 to the rotating control device 32, which diverts the flow returns through the flow connections 90*a* to the buffer manifold 80*a*, then to the choke manifold 80*b*, and further on to additional rig components 15, such as mud gas separator, trip tanks, mud pumps, mud standpipe manifold, standpipe flow line, etc. to finally be pumped down the drillstring 16. These rig components 15 can includes mud pumps, mud tanks, a mud standpipe manifold for a standpipe, a mud gas separator, a control system, and various other components. During drilling operations, these components 15 can operate in a known manner.

The drilling system 10 identifies downhole influxes and losses during drilling, for example, by monitoring circulation to maintain balanced flow for constant BHP under operating conditions and to detect kicks and lost circulation events that jeopardize that balance. The system 10 measures the flow-in and flow-out of the well and detects variations. In general, if the flow-out is higher than the flow-in, then fluid is being gained in the system 10, indicating a kick. By contrast, if the flow-out is lower than the flow-in, then drilling fluid is being lost to the formation, indicating lost circulation. To maintain balance, the system 10 can adjust surface backpressure with the choke manifold 80*b*.

In some situations, an uncontrolled release of wellbore fluids (e.g. high-pressure liquid and/or gas streams) may occur during drilling. The riser 20 with its rotating control device 32, annular isolation device 34, and flow components (36, 38) can then be configured to divert the uncontrolled wellbore fluid flow in a controlled fashion as described above.

In other situations, the well must be "killed" or otherwise controlled through well control operations. As shown in FIG. 1B, rig components (17*b*) for well control (e.g., kill-choke) connect with the BOP stack 40 and other components, sensors, or the like. In particular, a kill-choke manifold 80*c* on the rig 12 connected by the rig lines 88*a-b*, the rig manifold 150, and the riser manifold 100 can be used to control operations of the BOP stack 40, which may have one or more annular or ram-style blow out preventers. For example, a rig flow component 17*a*, such as a choke & kill manifold 80*d* on the rig 12, can connect through the flow connections 90*a* of the manifolds (110, 150) to actuators, valves, or other flow components 47*a* of the BOP stack 40. Also, rig controls 17*b* as shown in FIG. 1B can connect through the control connections 90*b* of the manifolds (110, 150) to rams, actuators, sensors, valves, or other control components 47*b* of the BOP stack 40.

The drilling system 10 can thereby be used to control operations of the BOP stack 40, which may have one or more annular or ram-style blow out preventers. As shown in FIG. 1A, for example, the kill line 29*a* can deliver heavy fluid to the wellbore 18 to "kill" the well. The drillstring 16 can be cut by a shear ram in the BOP stack 40, or a choke ram can be closed around the drillstring 16 in the BOP stack 40. In addition to kill and choke, the lines 29*a-b* may include conduits or lines for controlling hydraulic valves and connections in the BOP stack 40, and there may be "booster" lines for injecting fluid.

In addition to kill and choke, the lines 28*a-b* on the riser 20 in FIG. 1A may include other conduits or lines for controlling hydraulic valves and connections in the BOP stack 40, and there may be "booster" lines for injecting fluid. For example in FIG. 1B, a standpipe manifold 80*c* can connect through the flow connections 90*a* of the manifolds (110, 150) to a riser boost connection 47*a* of the BOP stack 40.

In addition to the connections outlined above, the rig lines 88*a-b* can connect to other components on the drilling system 10, such as glycol injection equipment. Thus, connections can be provided for a boost connection, a glycol injection connection, a hot connection, a spare connection, and a pumped riser connection. In addition to all of these components, the drilling system 10 also includes mud pumps, mud tanks, a mud standpipe manifold for a standpipe, a mud gas separator, a control system, and various other components (not shown). During drilling operations, these components can operate in a known manner.

The riser and rig manifolds 100, 150 consolidates the connections of the all of the various rig lines 88*a-b* from the rig 12 to the rotating control device 32, the annular device 34, flow components (36, 38), the riser lines 28*a-b*, the connections 108*a-b*, and other components when lowering the riser 20 from the rig 12 into the sea below. The lines 28*a-b* and connections 108*a-b* on the riser 20 can be preinstalled to extend from the riser manifold 100 to the various components 32, 34, 36, 38, 40, etc. and can carry the electric, hydraulic, and flow needed for operation. Rather than individually and manually connecting each of the various rig lines 88*a-b* to the rotating control device 32, annular isolation device 34, flow components (36, 38), riser lines 28*a-b*, and the like when lowering the riser 20 from the rig 12, the rig manifold 150 remotely connects the rig lines 88*a-b* to the riser manifold 100 on the riser 20 using an automated arm assembly, as discussed below.

Figure 2A:
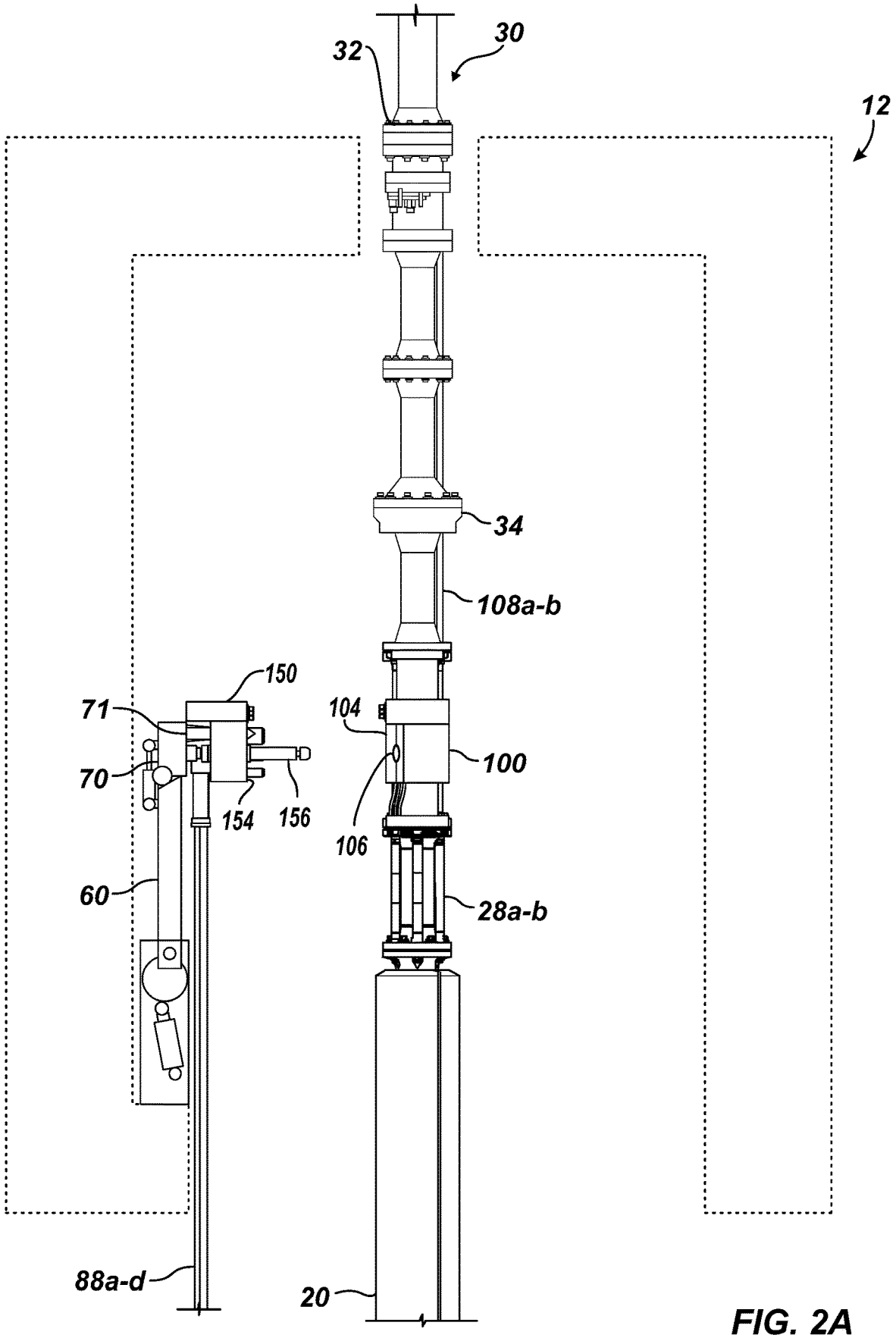
FIGS. 2A-2C illustrate operation of an arm assembly installing a rig manifold for rig lines to a riser manifold on a riser extending from a rig.
Figure 2B:
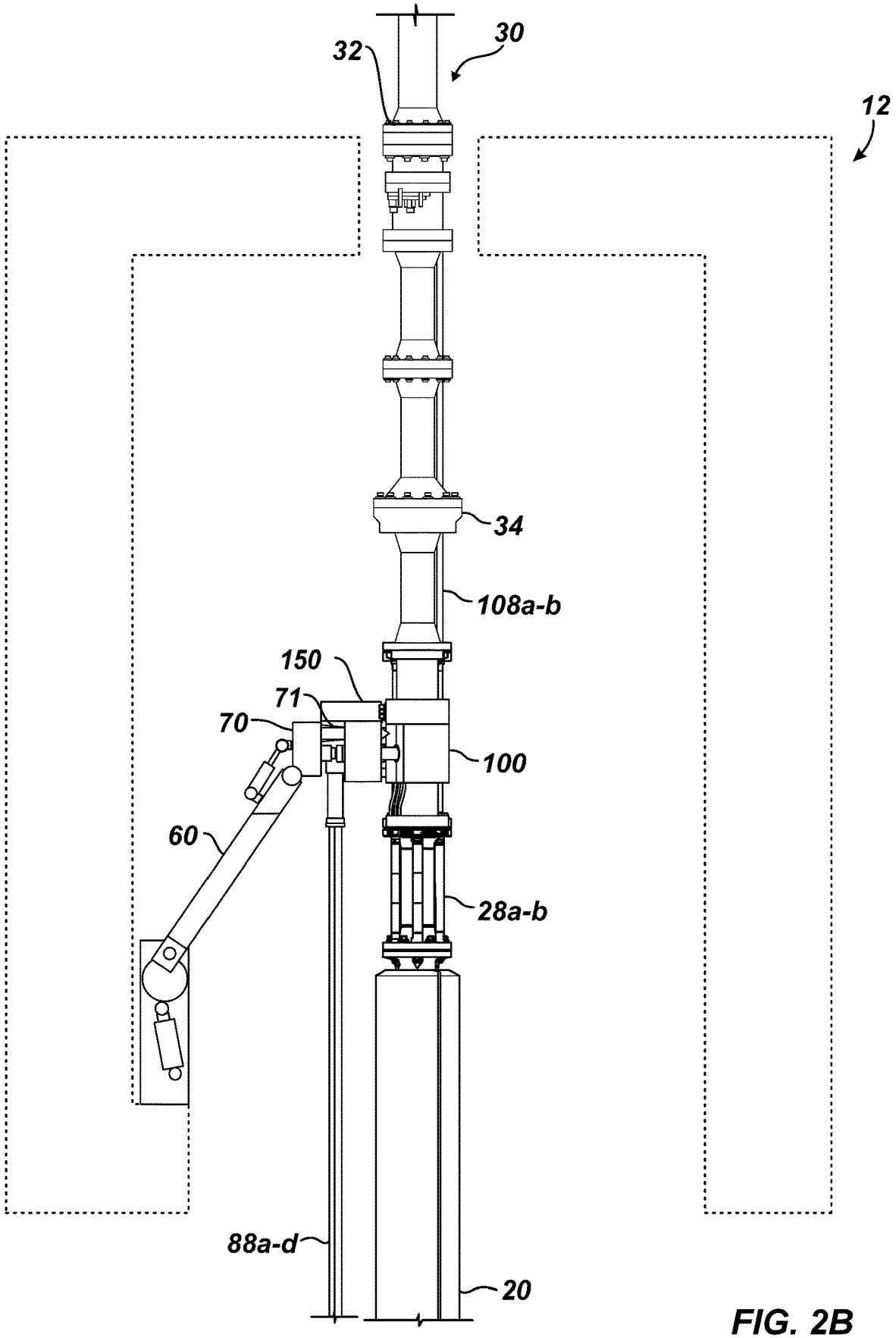
Figure 2C:
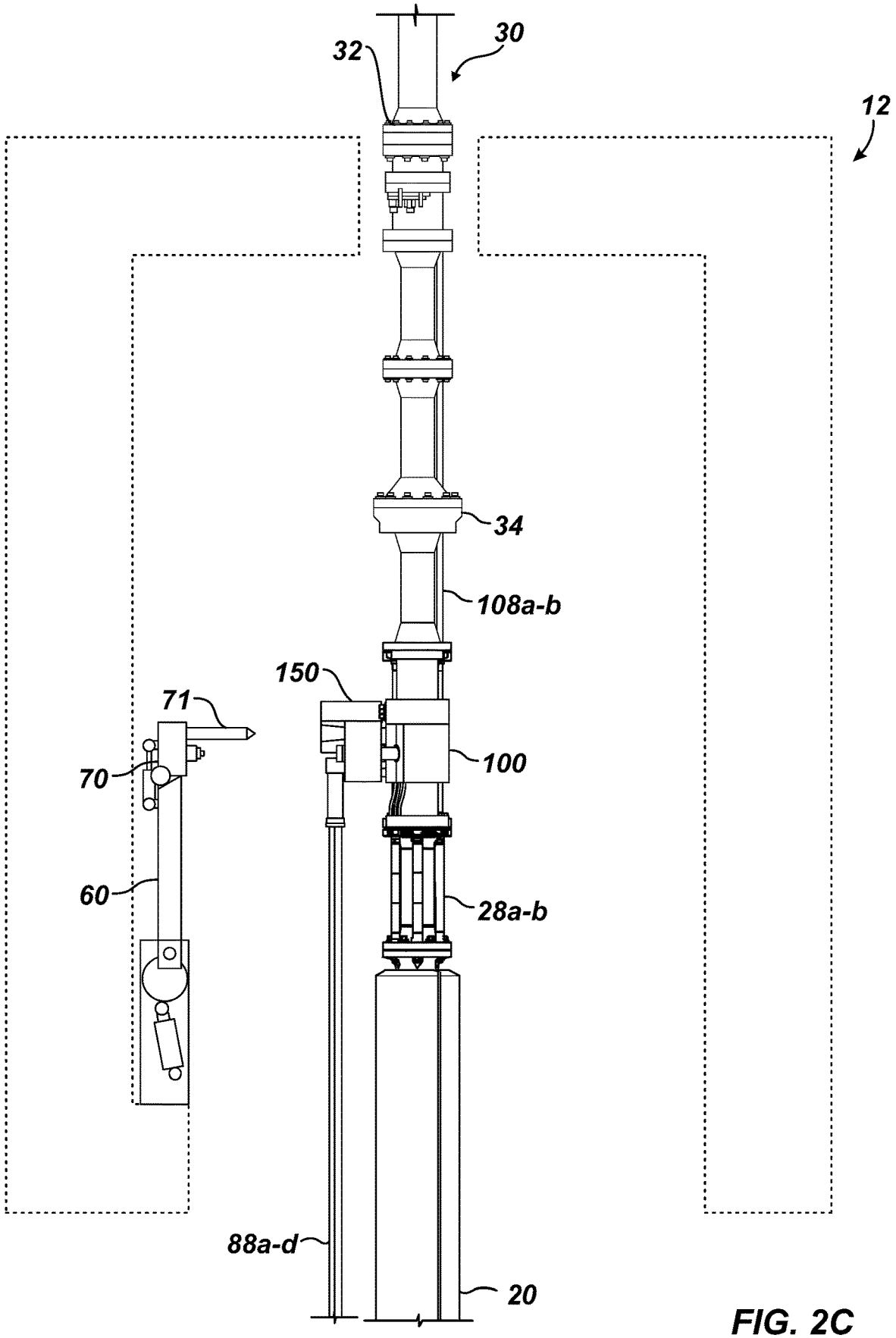

FIGS. 2A-2C illustrate operation of an arm assembly installing a rig manifold 150 for the rig lines 88*a-b* to a riser manifold 100 on the riser 20 below the rig 12. In FIGS. 2A-2C, a cross-section through a moonpool of the rig 12 is shown. The riser unit 30 hangs from a top drive (not shown) and extends down through an opening in a drilling deck and a diverter housing. The riser 20 extends from the riser unit 30 further down to the BOP stack (not shown), which is hung a desired elevation above the wellhead's depth.

At this point in the deployment, the BOP stack (40), the sections of the riser 20, riser unit 30, and the like have all been assembled and deployed from the rig 12. Operators have installed the riser manifold 100 and the flow control devices 32, 34, (36) of the riser unit 30 on the riser 20 and have connected the riser lines 28*a-b* and connections 108*a-b* to the riser manifold 100.

In these subsequent stages, the rig manifold 150 is now used to connect the rig lines 88*a-b* to the riser manifold 100 so flow and controls can be communicated between the rig 12 and the riser 30 (and its various components). In general, implementations may have one or more rig manifolds 150, and the multiple manifolds 150 may or may not be opposing one another. The rig lines 88*a-b* include at least one rig flow line 88*a* for conducting flow and include at least one rig control line 88*b* for conducting control. The riser lines 28*a-b* and/or riser connections 108*a-b* can include at least one riser flow line 28*a*/108*a* for conducting flow and include at least one riser control line 28*b*/108*b* for conducting control.

The riser manifold 100 disposed on the riser 20 has a face 104, which has at least one mechanical connector 106 disposed thereon, at least one first flow coupling (not shown), and at least one first control coupling (not shown). The at least one flow coupling can be disposed in fluid communication with a flow connection 108*a* for the rotating control device 32, the flow spool (36), etc. and/or with at least one of the riser flow lines 28*a* (to communicate with the BOP stack 40). The at least one first control coupling can be disposed in control communication with a control connection 108*b* for the rotating control device 32, the annular isolation device 34, the flow spool (36), etc. and/or at least one of the riser control line 28*b* (to communicate with the BOP stack 40).

The rig manifold 150 has a face 154 that removably positions adjacent the face 104 of the riser manifold 100. The face 154 has at least one second mechanical connector 156 disposed thereon, at least one second flow coupling (not shown), and at least one second control coupling (not shown). The at least one second flow coupling is disposed in fluid communication with the at least one rig flow line 88*a*, and the at least one second control coupling is disposed in control communication with the at least one rig control line 88*b*.

Either of the manifolds 100, 150 can have male and/or female elements for coupling and mating together. Preferably, however, the rig manifold 150 includes male elements (i.e., guide pins, pipe nipples, and couplings) for engaging in female elements (i.e., guide sleeves, pipe receptacles, and couplings) of the riser manifold 100 because the rig manifold 150 is manipulated relative to the riser manifold 100. Additionally, the riser manifold 100 preferably has the female elements so that less structure extends externally outside the circumference around the riser 20, which could become damaged while manipulating and lowering the riser 20.

As shown in FIG. 2A, the horizontally-directed rig manifold 150 with the rig lines 88*a-b* from the side of the platform is arranged to be directed horizontally to the face 104 on the riser manifold 100 disposed on the riser 20.

The rig manifold 150 is supported with a manipulator head 70 on a manipulator arm 60, and the flexible rig lines 88*a-b* from components on the rig 12 connect to the rig manifold 150. The manipulator arm 60 extends from the drilling platform and is manipulated to move the rig manifold 150 in a generally horizontal direction to connect to the riser manifold 100. In this way, connections can be established between the rig lines 88*a-b* to the riser lines 28*a-b*, to the riser connections 108*a-b*, and to the flow control devices (e.g., 32, 34, 36, 40) on the riser 20.

FIG. 2B shows the rig manifold 150 displaced inwards in a horizontal direction and "stabbed" into the riser manifold 100 on the riser unit 30. The at least one mechanical connector (156) of the rig manifold 150 is mechanically connected to the at least one mechanical connector (106) of the riser manifold 100. The at least one flow coupling of the rig manifold 150 is mated in at least one flow connection with the at least one flow coupling of the riser manifold 100 for conducting flow, and the at least one control coupling of the rig manifold 150 is mated in at least one control connection with the at least one control coupling of the riser manifold 100 for conducting control.

The manipulator arm 60 can be telescoping and/or pivoting and can be provided with links and hydraulics allowing the rig manifold 150 to be displaced when held in a desired position and elevation relative to the riser 20. The arm 60 may follow the riser's pendulum movement and possible small vertical movements. For example, the arm 60 may include a ball link on the manipulator arm's end and may include telescopic function to allow the arm 60 to move with pendulum movements of the riser 20 while the rig manifold 150 is in its connected state.

Additionally, the head 70 can be positioned on spherical bearings, allowing side-to side yaw movement to accommodate misalignment of the riser 20. For example, the head 70 can be misaligned up to 20 degrees either side. As soon as one guide post catches, the system aligns itself for a successful stab.

When an interconnection has been achieved, this flexibility of the arm 60 and head 70 allows the operations both for connecting (and later disconnecting) to be conducted in an orderly and controlled manner. This may also allow operations to extend the weather window for when to commence, conduct or continue riser operations and thus provide an economical advantage for the drilling rig 12 in addition to the time saving that the invention's method provides to the operation.

The head 70 on the manipulator arm 60 has a releasable connecting mechanism 71 to the rig manifold 150 for releasing the manipulator arm 60 from the rig manifold 150 after the rig manifold 150 has been connected to riser manifold 100. Additional details of the manipulator arm 60, the head 70, and the like can be found in U.S. Pat. No. 8,875,793, which is incorporated herein by reference in its entirety.

When the manipulator arm 60 has brought the rig manifold 150 into a secure engagement with the riser manifold 100, the hydraulics of the manipulator arm 60 may be set to idle so the manipulator arm 60 can follow the riser's movements. The hydraulic system for the manipulator arm 60 may not be activated until the releasable connector device 71 of the arm's head 70 has been disconnected and retracted from the rig manifold 150. For example, the rig manifold 150 has cam-locks on the guide posts (154). Once the cam-locks are locked, the arm 60 releases the head 70 from the rig manifold 150.

FIG. 2C shows a subsequent step with the releasable connector mechanisms 71 on the manipulator arms' head 70 released from the rig manifold 150, which remains connected to the riser manifold 100 on the riser unit 30. Connections have now been established from the rig's lines 88*a-b* to the riser's line 28*a-b*, the riser connections 108*a-b*, and the flow control devices (32, 34, 38, 40, etc.) via the rig manifold 150 and the riser manifold 100.

Once the connections have been completed, further operational steps can be performed. For example, the riser 20 can be lowered from the rig 12 to land the BOP stack (40) on the wellhead. The riser's load can be connected to tension line compensators, and the top of the inner barrel (not shown) can be connected to a flex joint and further up to a diverter housing on the rig 12.

Again and as noted previously, the manifolds 100, 150 may connect on the riser 20 at a level below the rotating control device 32 and the annular isolation device 34, such as described in FIGS. 2A-2C. Such an arrangement can help with organization of the system. As will be appreciated with the benefit of the present disclosure, however, other arrangements are possible.

Figure 3A:
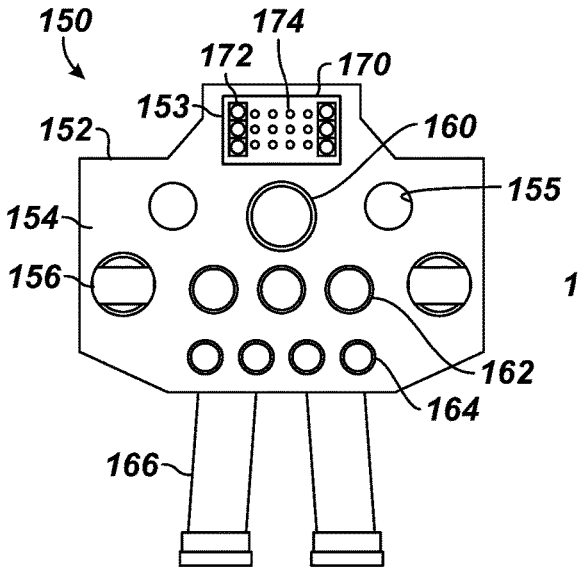
FIGS. 3A-3B respectively illustrate front and side views of a rig manifold according to the present disclosure.
Figure 3B:
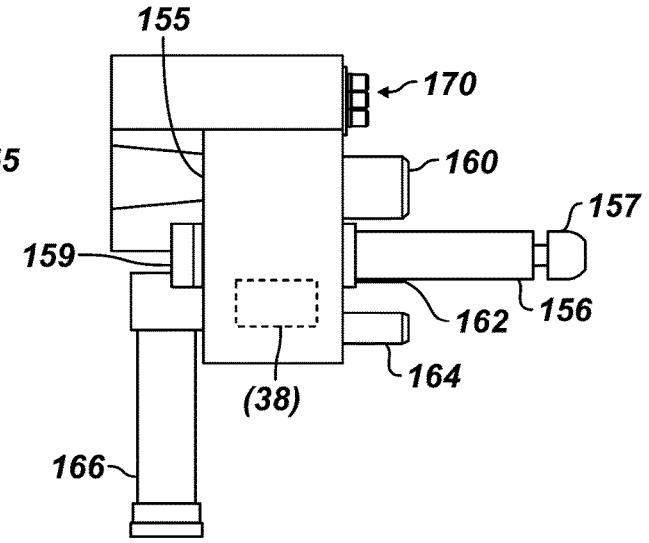
Figure 4:
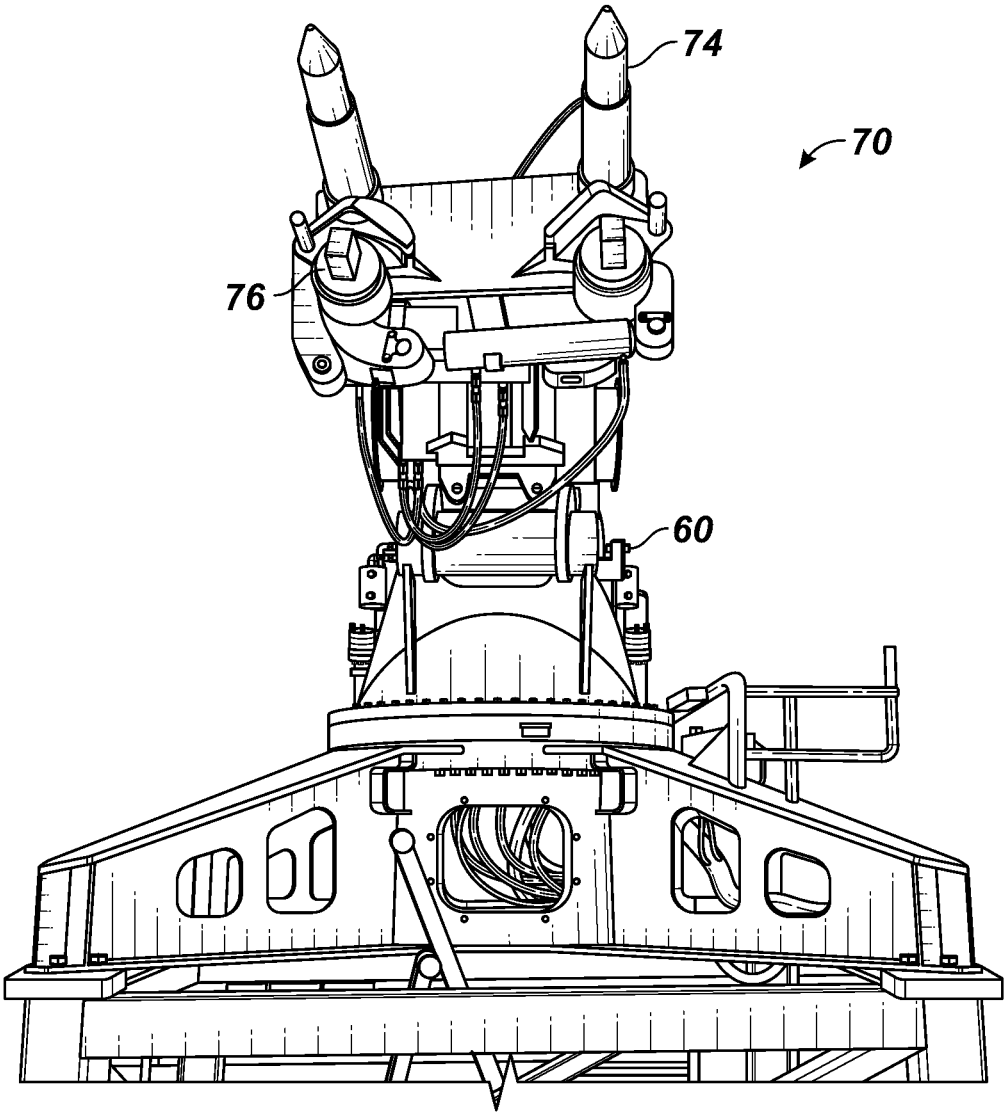
FIG. 4 illustrates an arm assembly according to the present disclosure.

Turning now to FIG. 3A-3B, front and side views of a rig manifold 150 according to the present disclosure are shown in more detail. The rig manifold 150 includes a body 152 having a front face 154 with support slots 155 for insertion on the carry posts (74; FIG. 4) of the head (70) for a manipulating arm (60). When inserted, the carry posts (74) can extend slightly from the face 154 and can help center and align the manifold 150 when it is brought against the riser manifold (not shown).

The mechanical connector on the rig manifold 150 includes a pair of guide posts 156 extending from the face 154 of the rig manifold 150. As disclosed herein, the guide posts 156 are arranged to be guided into a pair of guide sleeves (106) of the riser manifold (100). The guide posts 156 include locking heads or cam locks 157 with profiles that engage locking profiles in the guide sleeves (106) and are rotated and thereby locked. Cams 159 shown on the back of the rig manifold 150 in FIG. 3B allow actuators on the head (70) of the arm (60) to rotate these cam locks 157.

As shown here, the flow coupling of the rig manifold 150 includes a plurality of pipe nipples 160, 162, and 164 that extend from the face 154. The pipe nipples 160, 162, 164 are disposed in between the guide posts 156 and communicate internally with connections 166 for connecting to the riser flow lines (88*a*).

The control coupling of the rig manifold 150 can be installed directly in the face 152, or the rig manifold 150 can include stab or mating plates 170, 180 having control couplings. In general, the control couplings can include one or more of a male electrical coupling, a male hydraulic coupling, and a male fiber optic coupling. In particular, the rig manifold 150 can include one or more stab or mating plates 170 having control couplings, which can include one or more of a male electrical coupling, a male hydraulic coupling, and a male fiber optic coupling.

In particular, a stab plate 170 having control couplings can be disposed on the rig manifold 150 at the face 152. As shown here, the upper stab plate 170 can be disposed within a cavity 153 of the body 152. The stab plate 170 can float for adjustment in the cavity 153 when engaging a complimentary mating plate of the riser manifold (100) as discussed below. For example, the stab plate 170 may fit within the cavity 153 and may be held by pins, springs, and the like so it can shift relative to the face 154.

The stab plate 170 includes a plurality of control couplings 172, 174—each preferably male. For example, some of the male control couplings 172 can be used for electrical, while other of the male control couplings 174 can be used for fiber optic, hydraulic, and other communications. All of the control couplings 172, 174 can be wet-mate, ROV style connectors. Although not shown, the stab plate 170 can include guide pins for alignment, as discussed below.

A lower stab or mating plate 180 can be disposed below the face 152 or elsewhere. The lower stab plate 180 can also float for adjustment when engaging a complimentary plate of the riser manifold (100). The lower stab plate 180 includes a plurality of couplings 182—each preferably male, which can be used for electrical, fiber optic, hydraulic, and other communications.

Figure 3C:
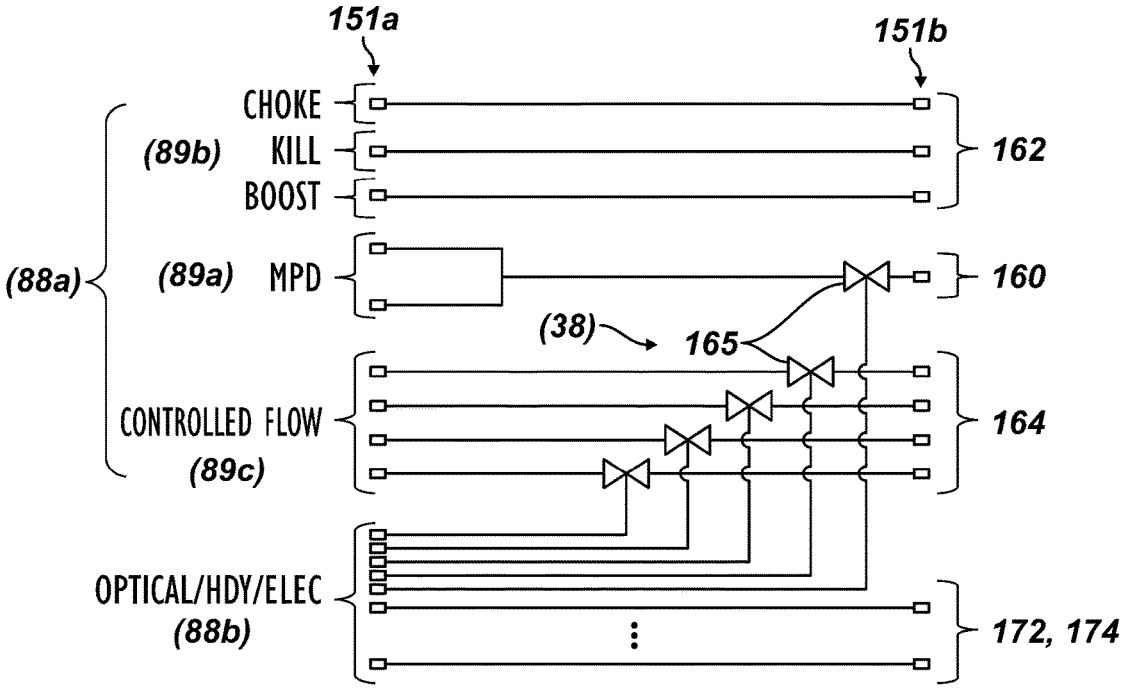
FIG. 3C illustrates a schematic of connections internal to the disclosed rig manifold.

As noted above, the rig manifold 150 can include flow components (38) internally for controlling flow between rig flow lines (88*a*) connected to the rig manifold 150 at the couplings 166 and elements of the riser (20). For example, FIG. 3C illustrates a schematic view of routes, lines, or connections internal to the rig manifold 150. Rig lines 88*a-b* are shown for connection to a rig-side fluid interface 151*a* of the rig manifold 150, while nipples and couplings 160, 162, 164, 172, 174 are shown on a riser-side interface 151*b* of the rig manifold 150 for connection to complementary elements of the riser manifold (not shown). The rig-side interface 151*a* can include flow and control connections on the rig manifold 150 for intermediate connection to rig lines 88*a-b*, or the rig lines 88*a-b* may simply extend on the manifold directly to the riser-side interface 151*b*.

One or more first flow lines 89*a* for managed pressure drilling connect at (or pass through) the rig-side interface 151*a* and connect internally in (or externally on) the rig manifold 150 to one or more first pipe nipples 160 on the riser-side interface 151*b*. For the purposes discussed previously, these first flow connections allow annular drilling returns from the internal annulus of the riser (20) sealed off by the rotation control device (32) or the annular isolation device (34) about the drillstring (16) to be communicated to the bypass and choke manifolds (80*a-b*) on the rig (12) so managed pressure drilling can be conducted.

Second flow lines 89*b* for choke, kill, and boost connect at (or pass through) the rig-side interface 151*a* and connect internally in (or externally on) the rig manifold 150 to second pipe nipples 162 on the riser-side interface 151*b*. These second flow connections allow choke, kill, and boost controls on the rig (12) to communicate via riser lines (28*a-b*) with the BOP stack (40) for the purposes discussed previously.

Third flow lines 89*c* for controlled flow connect at (or pass through) the rig-side interface 151*a* and connect internally in (or externally on) the rig manifold 150 to third pipe nipples 164 on the riser-side interface 151*b*. As shown, controllable valves 165 internal to the rig manifold 150 can be controlled to control flow between the flow lines 89*c* and the nipples 164.

For the purposes discussed previously, these third flow connections 89*c* can be used as the flow components (38) inside the manifold 150 and can allow for the internal passage (25) of the riser (20) to be selectively communicated with various rig components. For example, the internal passage (25) of the riser (20) sealed by the rotating control device (32) or the annular isolation device (34) can be communicated with the buffer manifold (80*a*) via these flow connections 89*c*. As will be appreciated, these third flow connections (without the internal valves 165) can communicate with a flow spool (36) having the valves if used on the riser unit (30). In other examples, these third flow connections 89*c* of the third pipe nipples 164 can provide flow for a glycol injection, a hot connection, a spare connection, and/or a pumped riser connection.

As further shown, a controllable valve 165 internal to the rig manifold 150 can be used to control the MPD flow between the flow lines 89*a* and the nipples 160. In fact, any suitable connection internal to the rig manifold 150 may have a controllable valve.

Finally, control lines 88*b* for optical, hydraulic, and/or electrical controls connect at (or pass through) the rig-side interface 151*a* and connect internally in (or externally on) the rig manifold 150 to control couplings 172, 174 on the riser-side interface 151*b*. As shown, some of these control lines 88*b* are used to control the controllable valves 165 internal to the rig manifold 150, but could instead be used for control of valves on a flow spool (36) if used on the riser unit (30). These control connections are used for the various purposes disclosed herein to control elements, such as the rotating control device (32), annular isolation device (34), flow spool (36), flow components (38), BOP stack (40), etc.

FIG. 4 illustrates a front view of an arm assembly according to the present disclosure for manipulating the rig manifold (150) of FIGS. 3A-3B. The assembly includes a head 70 disposed on a manipulator arm 60 mounted on a hub. The head 70 includes carry posts 74 on which the rig manifold (150) is supported. The carry posts 74 may be non-locking with the rig manifold (150). Guide post keys 76 of the head 70 are rotatable to turn the cams (159) for the locks (157) on the guide posts (156) of the rig manifold (150), as described below.

Figure 5A:
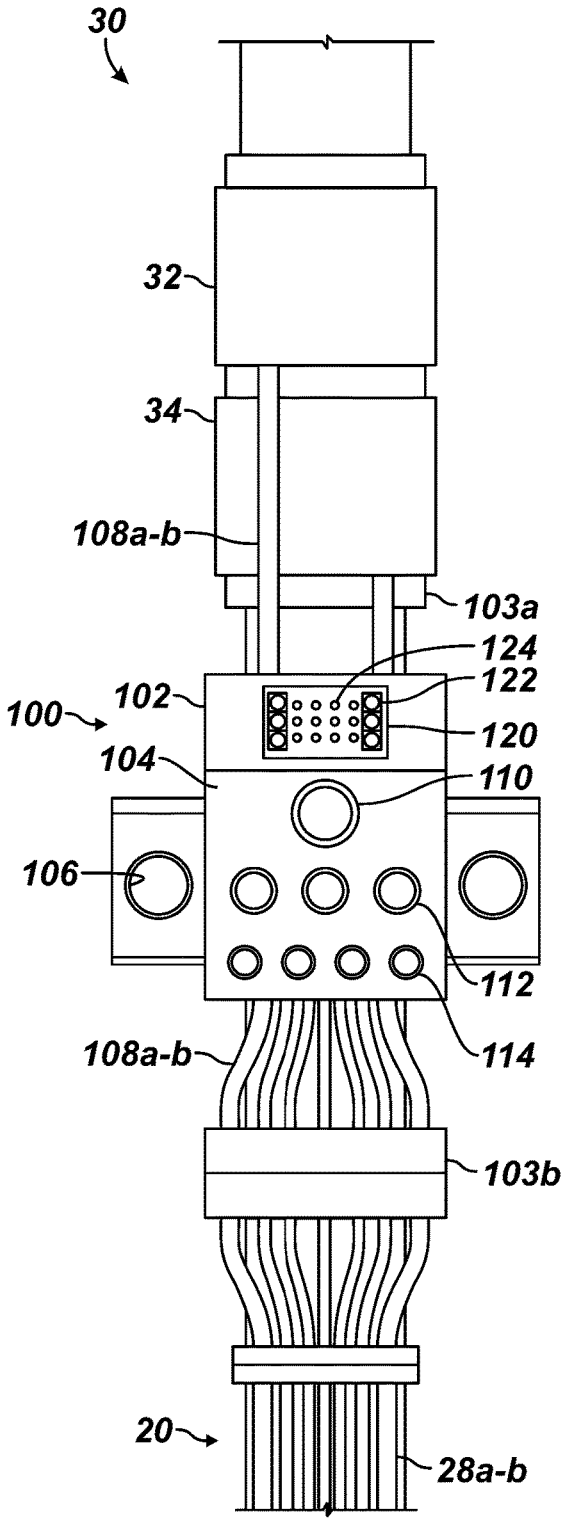
FIGS. 5A-5B respectively illustrate front and side views of a riser unit having a riser manifold according to the present disclosure.
Figure 5B:
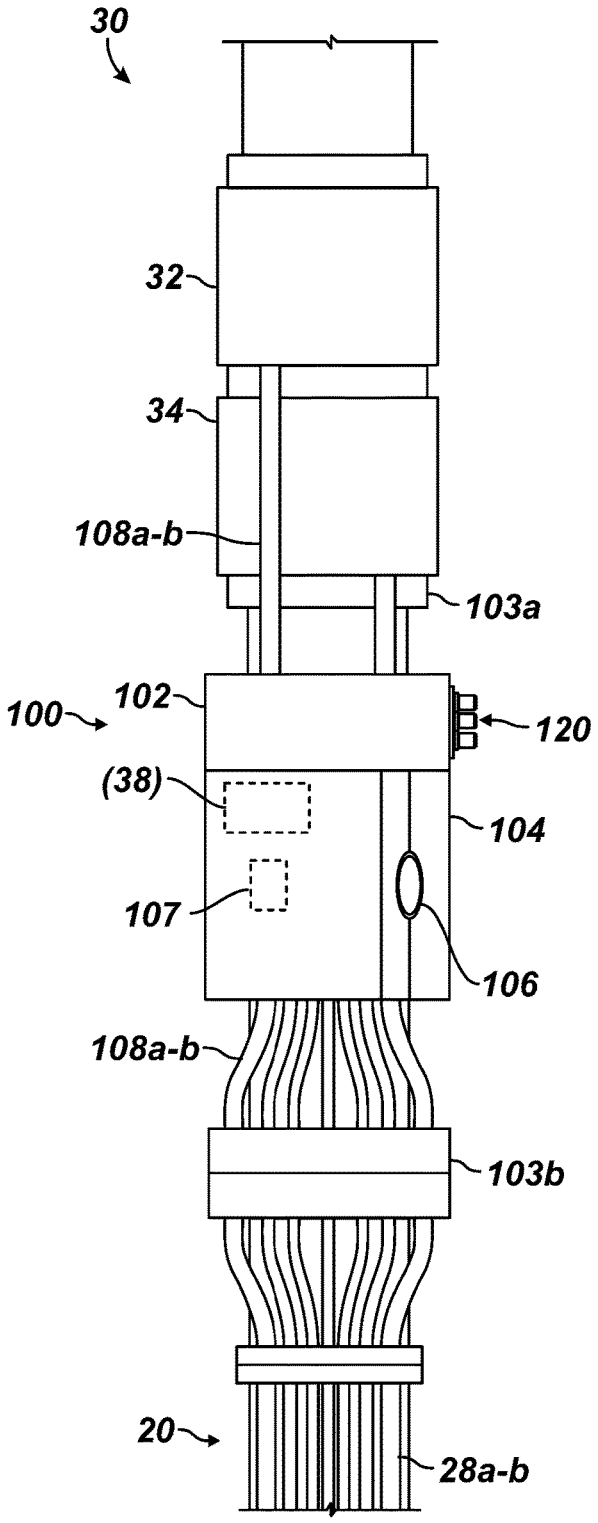

FIGS. 5A-5B illustrate front and side elevational views of the riser unit 30 having the flow control devices 32, 34 and the riser manifold 100. (A separate flow spool (36) is not shown in this example.) The manifold 100 includes a body 102 having flanged ends 103*a-b* for connection on the riser (20). For example, the upper flanged end 103*a* can connect to the annular isolation device 34, which itself can be connected below the rotating control device 32. The lower flanged end 103*b* can connect to stands of the riser 20.

The manifold's mechanical connector includes a pair of guide sleeves 106 defined in the face 104 of the manifold's body 102. The guide sleeves 106 receive the guide posts (156) of the rig manifold (150) when mated together. As schematically shown in the side view of FIG. 5B, these sleeves 106 include internal lock or cam surfaces (107) to engage the guide posts' locks (157) when rotated.

The flow couplings include female receptacles 110, 112, and 114 defined in the face 104 of the riser manifold 100. As disclosed herein, the male nipples (160, 162, and 164) of the rig manifold (150) are inserted into the female receptacles 110, 112, and 114 to mate the rig flow line(s) (88*a*) in fluid communication with the riser flow line(s) (28*a*) as well as manifold flow connections 108*a* discussed herein. Internally, the receptacles 110, 112, and 114 can include flow cushions to reduce the velocity of the fluid flow through the receptacles 110, 112, and 114 and reduce erosion in the bend of the receptacles 110.

A mating plate 120 is disposed on the face 104 for mating with the stab plate (170) of the rig manifold (150). The mating plate 120 has control couplings 122, 124—each preferably female, which can include one or more of a female electrical coupling, a female hydraulic coupling, and a female fiber optic coupling. A lower mating plate (not shown) can also be provided for additional control couplings as disclosed herein.

The mating plate 120 on the riser manifold 100 can be a fixed panel, but each of the individual couplings 122, 124 may be floating to facilitate fine alignment. Receptacles (not shown) can be disposed on the plate 120 to mate with the precision guideposts (176) on male stab plate (170). These receptacles can be composed of brass.

The stab plate (170; FIG. 3A-3B) includes the male couplings (172, 174) with external taper to insert into the female couplings 122, 124 with the internal taper of the mating plate 120. Again, the stab plate (170) is "floating" to facilitate alignment. Each of the couplings 122, 124/(172, 174) are depth-of-engagement tolerant connectors and include tapered male connectors to facilitate alignment and mating with the female connectors. (As will be appreciated, male and female couplings are used respectively on the opposite plates 170, 120, but a reverse configuration could be used. Moreover, each plate 170, 120 can include a mix of male and female couplings.)

As noted previously, these control couplings 122, 124/(172, 174) can connect to electric and hydraulic controls through the riser control lines (28*b*) and riser control connections 108*b*. The electric controls can be used for sensors, cameras, lights, etc. The hydraulic controls can be used for hydraulics to the rotating control device (32), annular isolation device (34), controllable valves or internal flow components (38), BOP stack 40, etc. As noted above and a schematically shown in FIG. 5B, the riser manifold 100 can include flow components (38) internally for controlling flow between the riser manifold 100 and elements of the riser (20).

Figure 5C:
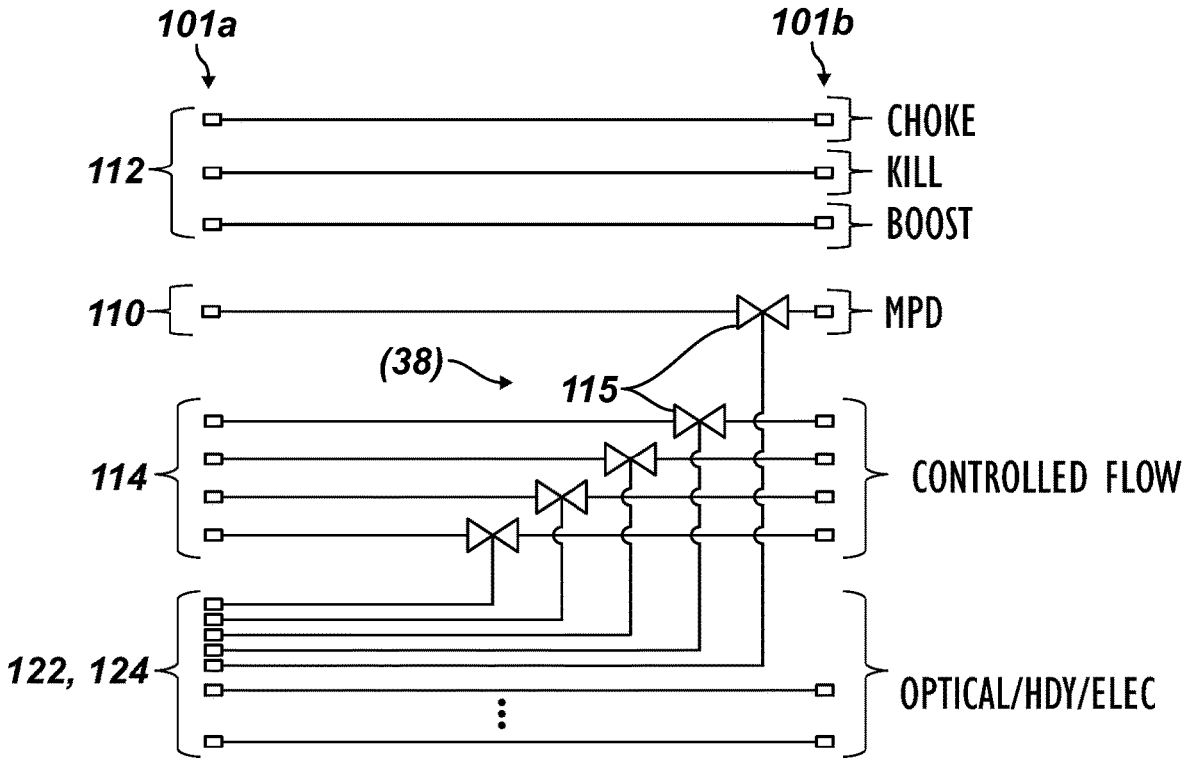
FIG. 5C illustrates a schematic of connections internal to the disclosed riser manifold.

Turning to FIG. 5C, a schematic view shows routes, lines, or connections internal to the riser manifold 100. (These connections can be provided in addition to or instead of the riser connections discussed previously.) A rig-side fluid interface 101*a* of the riser manifold 100 has the receptacles and couplings 110, 112, 114, 122, 124 for flow and control connections to the nipples and couplings (160, 162, 164, 172, 174) of the rig manifold (150). A riser-side interface 101*b* of the riser manifold 100 has complementary connections for the riser (20), such as for managed pressure drilling, choke, kill, boost, flow controls, optical, hydraulic, and electric elements.

One or more first flow connections for managed pressure drilling control connected to one or more nipple receptacles 110 at the rig-side interface 101*a* connect internally in (or pass externally on) the riser manifold 100 to MPD flow connection(s) on the riser-side interface 101*b*. For the purposes discussed previously, these first flow connections can allow annular returns from the internal annulus of the riser (20) sealed off by the rotation control device (32) around the drillstring (16) to be communicated to the bypass and choke manifolds (80*a*-*b*) on the rig (12) so managed pressure drilling can be conducted.

Second flow connections for choke, kill, and boost connected to nipple receptacles 112 at the rig-side interface 101*a* connect internally in (or pass externally on) the riser manifold 100 to choke, kill and boost connections on the riser-side interface 101*b*. These second flow connections allow choke, kill, and boost controls on the rig (12) to communicate via riser lines (28*a*) with the BOP stack (40) for the purposes discussed previously.

Third flow connections for flow control components connected to nipple receptacles 112 at the rig-side interface 101*a* connect internally in (or pass externally on) the rig manifold 100 to flow connections on the riser-side interface 101*b*. As shown, controllable valves 115 internal to the riser manifold 100 can be controlled to control flow between the receptacles 114 and the flow connections.

For the purposes discussed previously, these third flow connections can be used as the internal flow components (38) inside the riser manifold 100 and can allow for the internal passage of the riser (20) to be selectively communicated with various rig components. For example, the internal passage of the riser (20) sealed by the rotating control device (32) or the annular isolation device (34) can be communicated with the buffer manifold (80*a*) through these third connections. As will be appreciated, these third flow connections (without the internal valves 115) can communicate with a flow spool (36) if used on the riser unit (30). In other examples, these third flow connections of the third receptacles 114 can provide flow for a glycol injection, a hot connection, a spare connection, and/or a pumped riser connection.

As further shown, a controllable valve 115 internal to the riser manifold 100 can be used to control the MPD flow between the receptacles 110 and the MPD connections. In fact, any suitable connection internal to the riser manifold 100 may have a controllable valve.

Finally, control connections for optical, hydraulic, and/or electrical controls connected to couplings 122, 124 at the rig-side interface 101*a* connect internally in the rig manifold 100 to optical, hydraulic, and electrical control connections on the riser-side interface 101*b*. As shown, some of these control connections are used to control the controllable valves 115 internal to the riser manifold 100, but could instead be used for control of valves on a flow spool (36) if used on the riser unit (30). These control connections are used for the various purposes disclosed herein to control elements, such as the rotating control device (32), annular isolation device (34), flow spool (36), flow components (38), BOP stack (40), etc.

The engagement sequence of the rig manifold 150 to the riser manifold 100 of FIGS. 3A through 5B involves the main guide posts 156 initially fitting into the guide sleeves 106. As the rig manifold 150 is moved closer to the riser manifold 100, the flow connectors 160, 162, 164/110, 112, 114 mate with one another; the small guide posts (not shown) on the male stab plate 170 then engage the receptacles (not shown) on the mating plate 120; and the various couplings 122, 124/172, 174 finally mate together. Ultimately, the cam-locks 157 on the guide posts 156 are rotated to lock in the internal lock (107) of the riser manifold's sleeves 106.

Figure 6A:
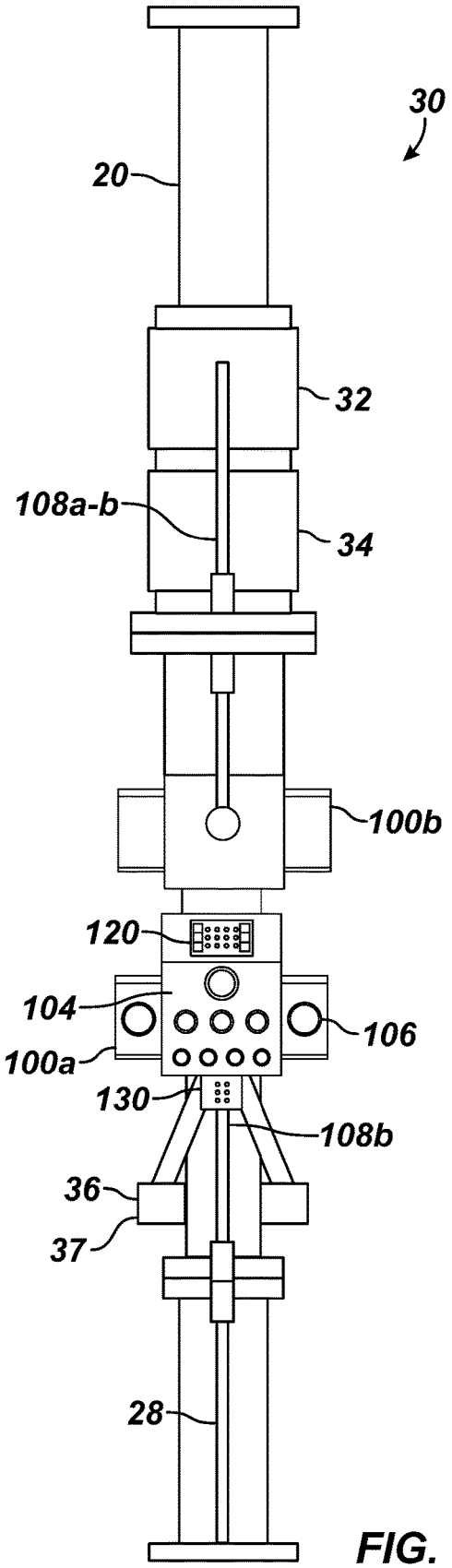
FIGS. 6A-6B respectively illustrate front and side views of another riser unit of the present disclosure.
Figure 6B:
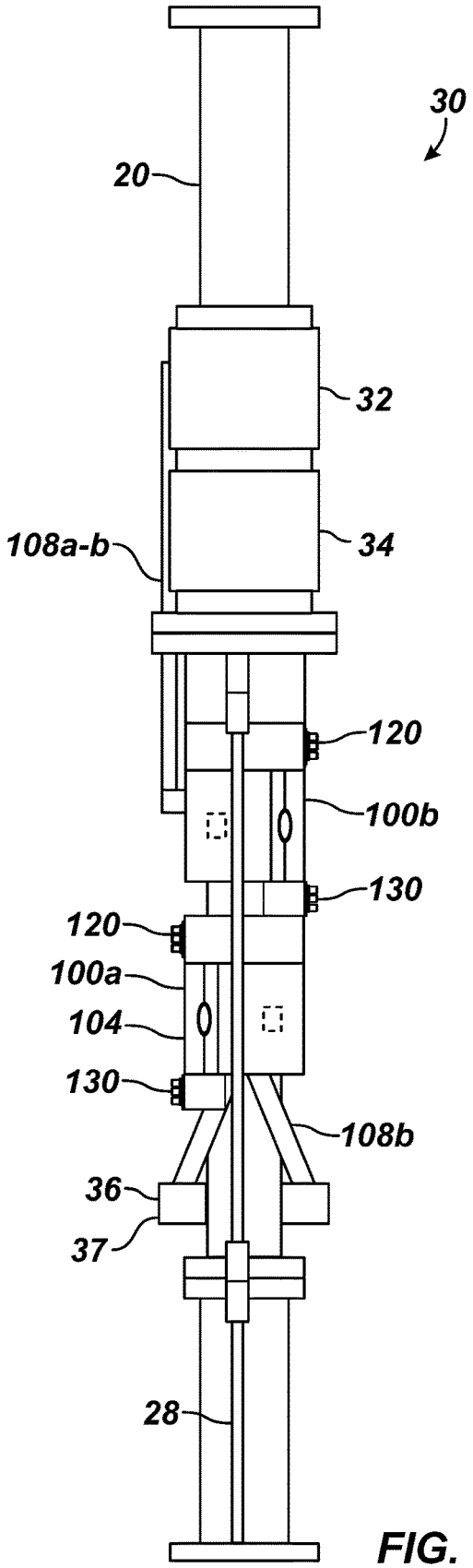

FIGS. 6A-6B illustrates elevational side views of another riser unit 30 of the present disclosure. This riser unit 30 can be similar to that discussed previously so that like reference numerals are used for comparable components. As before, the unit 30 includes flow control devices and a riser manifold. Here, the flow control devices include a rotating control device 32, an annular isolation device 34, and a flow spool 36 having controllable valves 37.

Here, the riser manifold 100 includes first and second riser manifolds 100*a*-*b* on opposing sides of the riser unit 30.

These riser manifolds 100*a-b* are similar to those disclosed above so like reference numerals are shown in the drawings but may not be referenced. As shown, the riser manifolds 100*a-b* each include guide sleeves 106 and flow receptacles (110, 112, 114) on the front face 104 as before. The riser manifolds 100*a-b* can also include upper and lower matting plate 120, 130 for the various connections as disclosed herein.

Figure 7:
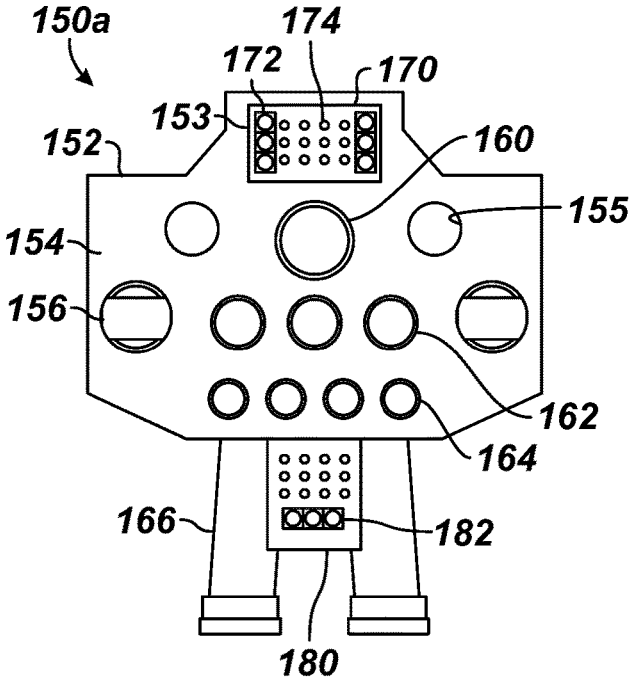
FIG. 7 illustrates a front view of another rig manifold for the present disclosures.

To connect with these opposing riser manifolds 100*a-b*, two rig manifolds 150*a-b*, such as the one illustrated in FIG. 7, are used. These rig manifolds 150*a-b* are similar to those disclosed above so that like reference numerals are used. As shown, the rig manifold 150*a-b* includes a front face 154 having support slots 155, guide posts 156 with locking heads or cam locks 157, and pipe nipples 160, 162, 164. The rig manifold 150 also includes upper and lower stab or mating plates 170, 180 having couplings for engaging the upper and lower mating plates (120, 130) of the riser manifold (100).

Figure 8:
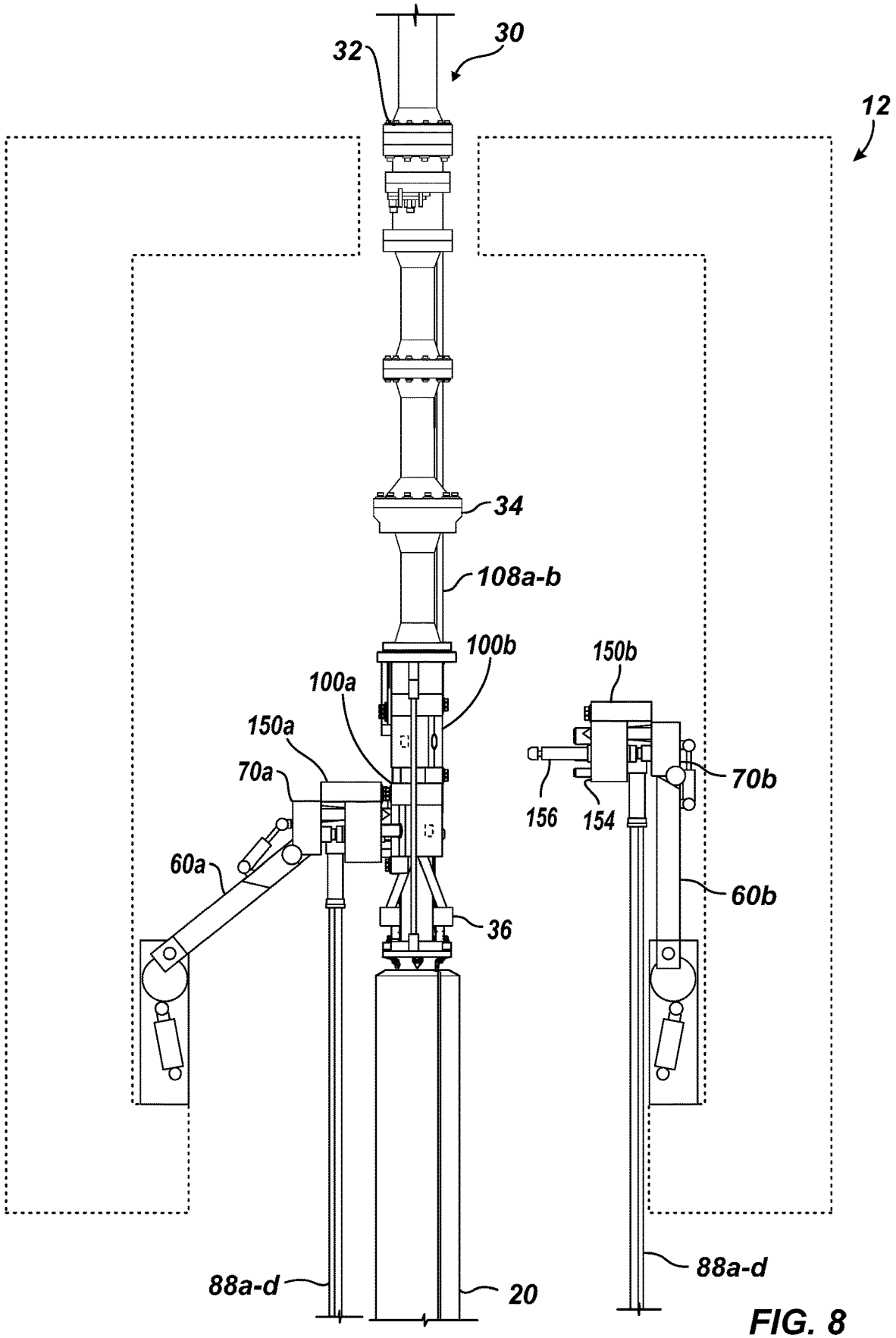
FIG. 8 illustrate operation of arm assemblies installing the rig manifolds of FIG. 7 for rig lines to the riser manifolds of FIGS. 6A-6B on the riser unit extending from a rig.

Because the riser unit 30 of FIGS. 6A-6B has opposing riser manifolds 100*a-b* that couple respectively to opposing rig manifolds 150*a-b* of FIG. 7, the installation assembly may use one arm or opposing arms on the rig. For example, FIG. 8 illustrate operation of arm assemblies 60*a-b* installing the rig manifolds 150*a-b* of FIG. 7 for rig lines 88*a-b* to the riser manifolds 100*a-b* of FIGS. 6A-6B on the riser unit 30 extending from a rig 12. As shown here, the rig manifolds 150*a-b* have been displaced inwards in horizontal directions and "stabbed" into the riser manifolds 100*a-b* on the sides of the riser unit 30. For each, the at least one mechanical connector (156) of the rig manifold 150*a-b* is mechanically connected to the at least one mechanical connector (106) of the riser manifold 100*a-b*.

Each of the manipulator arms 60*a-b* and the heads 70*a-b* can be similar to those discussed previously. Once connection has been made, the releasable connector device 71 of the arms' heads 70*a-b* can been disconnected and retracted from the rig manifold 150*a-b*.

With the manifolds 100*a-b*, 150*a-b* connected, the flow couplings of the rig manifold 150*a-b* are mated with the flow couplings of the riser manifold 100*a-b* for conducting flow. For example, one or more of the nipples (160, 162, 164) on the rig manifolds 150*a-b* mate with one or more of the receptacles (110, 112, 114) on the riser manifolds 100*a-b*. The resulting flow connections can be used to communicate rig flow line(s) (88*a*) with the annulus of the rotating control device (32) and/or to communicate rig flow line(s) (88*a*) with the flow spool (36) and its valve (37). The resulting flow connections can be used to communication with other components on the riser unit 30, riser 20, BOP stack 40, etc. For examples, the flow connections can connect to the riser lines 28*a* to extend to the BOP stack 40.

With the manifolds 100*a-b*, 150*a-b* connected, the control couplings of the rig manifold 150*a-b* are mated with the control couplings of the riser manifold 100*a-b* for conducting control. For example, the upper mating plates (120, 170) mate together to complete control connections. Likewise, the lower mating plates (130, 180) mate together to complete additional control connections. The resulting control connections can be used to communicate rig control line(s) (88) with the rotating control device (32), with the annular isolation device (34), and with the flow spool (36) and its valve (37), as well as any other components on the riser unit 30, riser 20, BOP stack 40, etc.

As shown in FIG. 8, the manifolds 100*a-b*, 150*a-b* may connect on the riser 20 at the same level along the riser 20 and at different sides thereof. They may even be connected about the same time in the installation sequence. Such an arrangement can help with organization of the drilling system 10. As will be appreciated with the benefit of the present disclosure, however, other arrangements for the rig lines 88*a-b* and the manifolds 100*a-b*, 150*a-b* are possible. For example, the manifolds pairs 100*a*, 150*a* and 100*b*, 150*b* may connect on the riser 20 at different levels along the riser 20 and can be disposed at the same side so that one arm assembly can be used at different times in the installation process to install each of the rig manifolds 150*a-b* to its respective riser manifold 100*a-b*. In some embodiments, riser manifolds 100*a-b* may be oriented in other directions relative to one another. Although examples disclosed herein are shown with one riser manifold 100 or first and second riser manifolds 100*a-b*, some embodiments may include more riser manifolds such as three, four, five, or any suitable or practical number of riser manifolds. A rig, such as rig 12, may include a corresponding number of rig manifolds for connection with the riser manifolds, such as a rig manifold for each riser manifold.

Figure 9A:
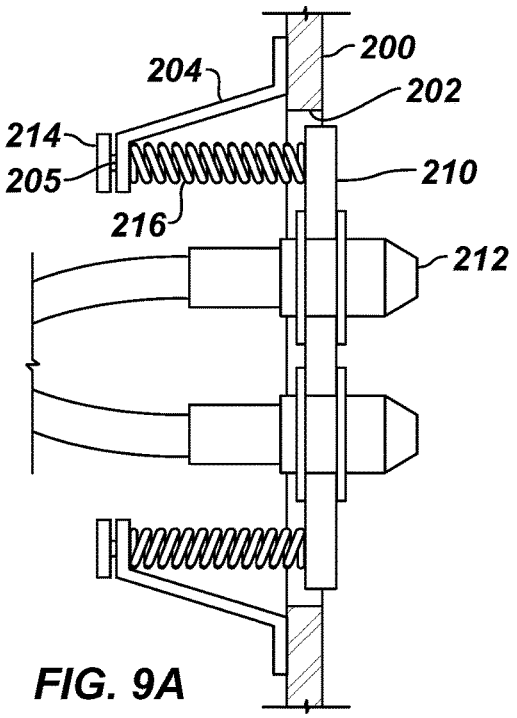
FIGS. 9A-9B schematically illustrate a mating plate of the present disclosure adjustable relative to the face of a manifold.
Figure 9B:
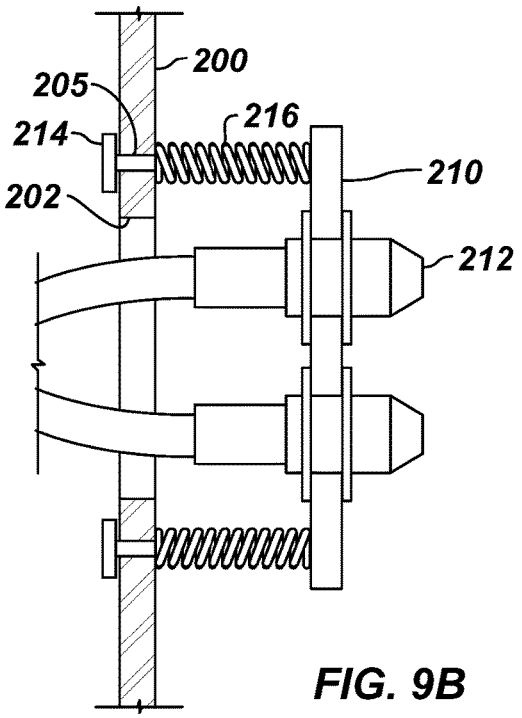

As noted above, the mating plates, such as the stab plate 170 on the rig manifold 150, can be "floating," meaning the plate 170 can adjust relative to the face of the rig manifold 150. It is possible for the mating plate (120) on the riser manifold (100) to instead be floating or to also be floating. FIGS. 9A-9B schematically illustrate a mating plate 210 of the present disclosure adjustable relative to a face 200 of a manifold. The mating plate 210 can be any of the mating plates disclosed herein on the manifolds.

As shown in FIG. 9A, the face 200 of the manifold defines an opening 202 into an internal cavity of the manifold. The mating plate 210 is mounted in the opening 202 and supports the control couplings 212 thereon. One or more adjustable fixtures support the mating plate 210 in the opening 202 and allow the plate 210 to adjust relative to the manifold's face 200. For instance, the plane of the plate 210 may adjust relative to the plane of the face 200.

A number of different adjustable fixtures could be used. As shown here, pins 212 extend from the back of the plate 210 and can slide longitudinally in brackets 204 attached in the opening 202 of the manifold. Biasing springs 216 on the sliding pins 214 push the plate 210 outward from the face 200 and allow the pins 214 to adjust longitudinally in the brackets 204. Additional freedom of movement can be provided by allowing the pins 214 to move laterally in slots 205 in the brackets 204 so that the plate 210 can adjust laterally in the opening 202.

As shown an alternative arrangement in FIG. 9B, pins 212 extend from the back of the plate 210 and can slide longitudinally in the face 200 of the manifold. Biasing springs 216 on the sliding pins 214 push the plate 210 outward from the face 200 and allow the pins 214 to adjust longitudinally in the face 200. Additional freedom of movement can be provided by allowing the pins 214 to move laterally in slots 205 in the face 200 so that the plate 210 can adjust laterally.

Figure 9C:
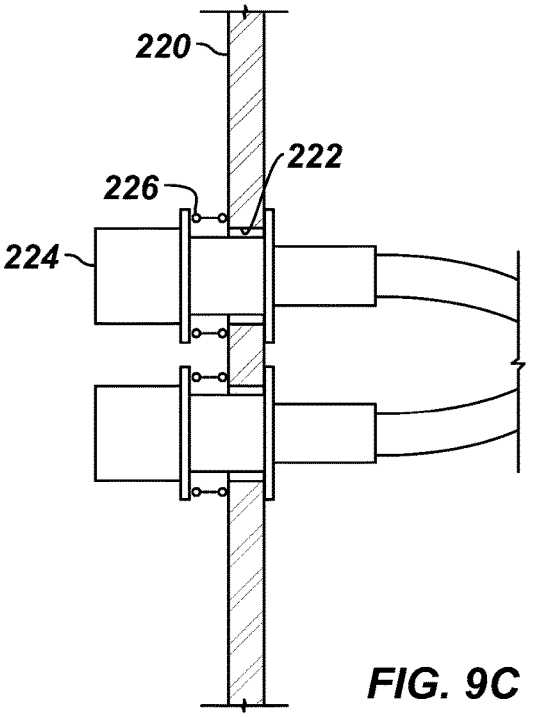
FIG. 9C schematically illustrates a mating plate of the present disclosure having a coupling adjustable relative to the face of a manifold.

As noted herein, each coupling on a mating plate, such as the couplings 172, 174 on the rig manifold's mating plate 170 can be adjustable/movable relative to the face 154 of the manifold 150. To that end, FIG. 9C schematically illustrates a mating plate 220 of the present disclosure having a female coupling 224 adjustable relative to the face of a manifold. The plate 220 can be part of the manifold's face or may be affixed thereto. The mating plate 220 defines openings 222 for control couplings 224, such as hydraulic, electrical, and optical communication. A biasing element 226 such as a spring disposed between the coupling 224 and the plate 220 can allow for individual adjustment or movement of the female coupling 224 to facilitate its mating with a corresponding male coupling on the mating plate of the other manifold.

Figure 10:
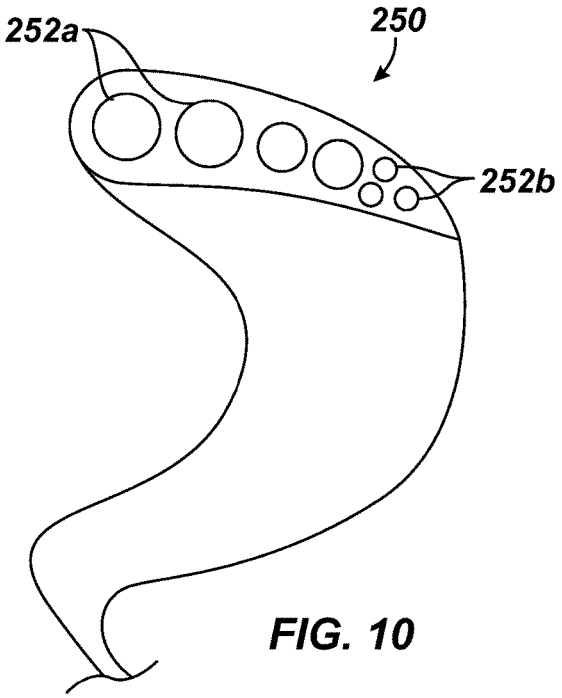
FIG. 10 illustrates a schematic view of a cable for the rig lines of the present disclosure.

FIG. 10 illustrates a schematic view of a cable 250 for the rig lines 88*a-b* of the present disclosure. The rig lines 88*a-b* (e.g., hoses, umbilicals, etc.) leading from the rig (12) to the riser (20) are preferably combined into a single hydrodynamically-shaped bundle for the cable 250. The bundled cable 250 resists vortex-induced vibration (VIV) of the auxiliary hoses and umbilicals and provides for reduced wear and easy handling. A polyurethane profile clamp can be used for bundling the hoses in the cable 250.

Although discussed in conjunction with a rig manifold coupling to a riser manifold using a manipulator arm, the teaching of the present disclosure can be used in other implementations. For example, the teachings can be used for automated subsea stabbing operations of subsea multi-stab connection plates performed with or without an ROV.

Although discussed in conjunction with flow line, hydraulic umbilicals, electric cables, and the like, the teaching of the present disclosure can be used for coupling any number of high-flow and low-flow, high-pressure and low-pressure fluid/hydraulic connections, electrical connections, fiber optic connections, and the like, which can be combined in a single automated subsea stabbing operation with or without the use of an ROV. For example, applications can include: recoverable BOP pods; riser top connections for MPD and combined MPD/termination joint connections on MODUs; and production control systems, such as intelligent well systems, artificial lift, and others.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. An apparatus for connecting rig lines on a floating rig to a riser, the rig lines belonging to a managed pressure drilling (MPD) system and a kill-choke system on the floating rig, the rig lines including a first MPD flow line in communication with the MPD system and including a first kill-choke flow line in communication with the kill-choke system, the riser having an internal passage, the apparatus comprising:

a riser manifold disposed on the riser and comprising: a first mechanical connector disposed thereon, a first flow coupling for conducting a first MPD flow of the MPD system, and a second flow coupling for conducting a first kill-choke flow of the kill-choke system; and a rig manifold being configured to be removably positioned adjacent to the riser manifold, the rig manifold comprising: a second mechanical connector disposed thereon, a third flow coupling disposed in flow communication with the first MPD flow line for conducting the first MPD flow, and a fourth flow coupling disposed in flow communication with the first kill-choke flow line for conducting the first kill-choke flow, the first and second mechanical connectors configured to mechanically connect together, the third flow coupling configured to mate in a first MPD flow connection with the first flow coupling for conducting the first MPD flow, the fourth flow coupling configured to mate in a first kill-choke flow connection with the second flow coupling for conducting the first kill-choke flow.

2. The apparatus of claim 1, the rig lines including at least one second MPD flow line in communication with the MPD system, wherein the riser manifold comprises at least one fifth flow coupling for conducting at least one second MPD flow of the MPD system; and wherein the rig manifold comprises at least one sixth flow coupling disposed in flow communication with the at least one second MPD flow line for conducting the at least one second MPD flow, the at least one sixth flow coupling configured to mate in at least one second MPD flow connection with the at least one fifth flow coupling for conducting the at least one second MPD flow.

3. The apparatus of claim 2, the rig lines including at least one second kill-choke flow line in communication with the kill-choke system, wherein the riser manifold comprises at least one seventh flow coupling for conducting at least one second kill-choke flow of the kill-choke system; and wherein the rig manifold comprises at least one eighth flow coupling disposed in flow communication with the at least one second kill-choke flow line for conducting the at least one second kill-choke flow, the at least one eighth flow coupling configured to mate in at least one second kill-choke flow connection with the at least one seventh flow coupling for conducting the at least one second kill-choke flow.

4. The apparatus of claim 2, wherein the at least one second MPD flow conducted by the at least one second MPD connection is different from the first MPD flow conducted by the first MPD connection.

5. The apparatus of claim 1, wherein the first mechanical connector comprises a pair of guide sleeve defined in a first face of the riser manifold; and wherein the second mechanical connector comprises a pair of guide posts extending from a second face of the rig manifold, the guide posts configured to insert into the guide sleeves to mechanically connect the rig manifold to the riser manifold.

6. The apparatus of claim 1, wherein the first flow coupling comprises a female receptacle defined in a first face of the riser manifold; and wherein the second flow coupling comprises a male nipple extending from a second face of the rig manifold, the male nipple configured to insert into the female receptacle to make the first MPD flow connection.

7. The apparatus of claim 1, further comprising an arm extending from the floating rig and supporting the rig manifold, the arm configured to: move the rig manifold relative to the riser manifold, mate the rig manifold to the riser manifold, and disconnect from the rig manifold.

8. The apparatus of claim 7, wherein:

the arm is further configured to: connect to the rig manifold mated with the riser manifold, and remove the rig manifold from the riser manifold;

the rig manifold defines a plurality of carry slots therein and the arm comprises a plurality of carry posts removably inserted in the slots of the rig manifold;

and/or the second mechanical connector comprises a rotatable lock and the arm comprises a rotatable key removably engaging the rotatable lock.

9. The apparatus of claim 1, the rig lines including a control line for conducting control, wherein a first face of the riser manifold further comprises a first control coupling for conducting the control; and wherein a second face of the rig manifold further comprises a second control coupling for conducting the control, the second control coupling being configured to mate in a control connection with the first control coupling for conducting the control.

10. The apparatus of claim 9, wherein:

the first control coupling comprises a female electrical coupling, a female hydraulic coupling, and a female fiber optic coupling;

the second control coupling comprises a male electrical coupling, a male hydraulic coupling, and a male fiber optic coupling; and/or each of the first and second control couplings is adjustable relative to the first and second face.

11. The apparatus of claim 9, wherein the riser manifold comprises a valve integrated therein, the valve controllable with the control connection and configured to control the flow communication for the first MPD flow connection.

12. The apparatus of claim 9, comprising:

a first mating plate disposed on the first face and having the first control coupling; and a second mating plate disposed on the second face and having the second control coupling, at least one of the first and second mating plates being adjustable relative to the respective first and second faces.

13. The apparatus of claim 12, wherein:

the second face defines a cavity therein and the second mating plate is disposed in the cavity; and/or the second mating plate is adjustable longitudinally, laterally, or both relative to the second face.

14. The apparatus of claim 9, further comprising a flow control device disposed on the riser and being configured to at least partially control communication of the internal passage of the riser, the flow control device being disposed in at least one of: (i) flow communication with the first flow coupling, (ii) flow communication with the second flow coupling, and (iii) control communication with the first control coupling.

15. The apparatus of claim 14, wherein the flow control device comprises a valve disposed in the flow communication with the first flow coupling and disposed in the control communication with the first control coupling, the valve being controllable to control the flow between the first flow coupling and the internal passage of the riser.

16. The apparatus of claim 14, wherein the flow control device comprises a seal being configured to at least partially control flow in the internal passage of the riser.

17. The apparatus of claim 16, wherein the seal comprises an actuator disposed in the control communication with the first control coupling.

18. The apparatus of claim 14, the riser having riser lines including a riser flow line for conducting the flow and including a riser control line for conducting the control, wherein the first or second flow coupling is disposed in the flow communication with the flow control device via the riser flow line, and wherein the first control coupling is disposed in the control communication with the flow control device via the riser control line.

19. The apparatus of claim 14, wherein the flow control device comprises at least one of:

a rotating control device disposed in the control communication with the first control coupling;

an annular seal device disposed in the control communication with the first control coupling; and a controllable flow spool valve disclosed in the control communication with first control coupling and disposed in the flow communication between the internal passage of the riser and the first flow coupling.

20. The apparatus of claim 14, wherein the flow control device comprises a wellhead component of a blow-out preventer connected to the riser and disposed in the flow communication between the internal passage of the riser and the second flow coupling.

21. The apparatus of claim 1, wherein the riser and rig manifolds comprise another flow connection between fifth couplings comprising at least one of a boost connection, a glycol injection connection, a hot connection, a spare connection, and a pumped riser connection.

22. The apparatus of claim 1, wherein at least one of the rig and riser manifold comprises a valve integrated therein, the valve controllable with a control connection and configured to control the flow communication for the first MPD flow connection.

23. The apparatus of claim 21, the rig lines including an MPD control line in communication with the MPD system, wherein the rig manifold comprises the valve integrated therein and disposed in control communication with the MPD control line.

24. The apparatus of claim 1, the rig lines including a rig control line for conducting control, wherein the riser manifold comprises a first control coupling for conducting the control;

wherein the rig manifold comprises a second control coupling for conducting the control, the second control coupling configured to mate in a control connection with the first control coupling for conducting control; and wherein at least one of the riser and rig manifolds comprises a valve integrated therein, the valve being controllable with the control connection and being configured to control flow communication for the MPD flow connection between the rig flow line and the riser.

25. The apparatus of claim 24, further comprising a flow control device disposed on the riser and being configured to at least partially control fluid communication through the internal passage of the riser, the flow control device disposed in communication with at least one of the first flow coupling and the first control coupling.

26. An apparatus for connecting rig lines on a floating rig to a riser, the rig lines belonging to a managed pressure drilling (MPD) system and a kill-choke system on the floating rig, the riser having an internal passage and having a kill-choke line for a kill-choke component, the apparatus comprising:

a managed pressure drilling (MPD) device disposed on the riser and being configured to at least partially control fluid communication through the internal passage of the riser;

a riser manifold disposed on the riser and comprising: a first mechanical connector disposed thereon, a first coupling disposed in communication with the MPD device, and a second coupling disposed in communication with the kill-choke line; and a rig manifold configured to be removably positioned adjacent to the riser manifold, the rig manifold comprising: a second mechanical connector disposed thereon, a third coupling disposed in communication with the MPD system, and a fourth coupling disposed in communication with the kill-choke system, the first and second mechanical connectors configured to mechanically connect together, the third coupling configured to mate with the first coupling and configured to communicate therewith, the fourth coupling configured to mate with the second coupling and configured to communicate therewith.

* * * * *